US006109195A

United States Patent [19]

Inagaki et al.

[11] Patent Number: 6,109,195

[45] Date of Patent: Aug. 29, 2000

[54] OVER-LOCK SEWING MACHINE

[75] Inventors: Hidetaka Inagaki; Nobusuke Nagasaka, both of Aichi; Katsuya Watarai, Gifu, all of Japan

[73] Assignee: Brother Kogyo Kabushiki Kaisha, Nagoya, Japan

[21] Appl. No.: 09/135,573

[22] Filed: Aug. 18, 1998

[30] Foreign Application Priority Data

Aug. 18, 1997 [JP] Japan ..... 9-237802

[51] Int. Cl.[7] ..... D05B 1/20; D05B 19/12

[52] U.S. Cl. ..... 112/470.01; 112/130; 112/162; 112/199; 112/220

[58] Field of Search ..... 112/470.01, 162, 112/197, 199, 130, 168, 475.26, 220, 117

[56] References Cited

U.S. PATENT DOCUMENTS

| | | | |
|---|---|---|---|
| 4,357,887 | 11/1982 | Hara et al. | 112/199 X |
| 4,742,787 | 5/1988 | Buzzi | 112/162 |
| 4,895,088 | 1/1990 | Pirello et al. | 112/130 |
| 5,134,948 | 8/1992 | Suzuta et al. | 112/162 |
| 5,509,365 | 4/1996 | Cash | 112/117 |
| 5,860,377 | 1/1999 | Akahane et al. | 112/220 X |

FOREIGN PATENT DOCUMENTS

| | | |
|---|---|---|
| 62-16785 | 1/1987 | Japan . |
| 7-659 | 1/1995 | Japan . |

*Primary Examiner*—Peter Nerbun
*Attorney, Agent, or Firm*—Oliff & Berridge, PLC

[57] ABSTRACT

An over-lock sewing machine executing an over-edge chain stitch and a double-chain stitch includes a sewing machine motor for driving a needle bar so that the needle bar is moved upward and downward, a sewing needle mounted on a lower end of the needle bar, an upper looper and a lower looper forming stitches in cooperation with the sewing needle, and a stepping motor for driving the lower looper so that the lower looper is rocked.

30 Claims, 19 Drawing Sheets

| SEWING MODE | FIRST SWITCH | SECOND SWITCH | DOOUBLE-CHAIN STITCH LED | MOVING BLADE LED |
|---|---|---|---|---|
| OVER-EDGE CHAIN STITCH (WITH CLOTH BEING CUT) | OFF | OFF | OFF | OFF |
| OVER-EDGE CHAIN STITCH (WITHOUT CLOTH BEING CUT) | OFF | ON | OFF | ON |
| DOUBLE-CHAIN STITCH (WITH CLOTH BEING CUT) | ON | OFF | ON | OFF |
| DOUBLE-CHAIN STITCH (WITHOUT CLOTH BEING CUT) | ON | ON | ON | ON |

FIG.14A

| SEWING MODE | LOWER LOOPER ROCKING FIRST STEPPING MOTOR | UPPER LOOPER ROCKING SECOND STEPPING MOTOR | LOWER LOOPER FORWARD AND BACKWARD DRIVING THIRD STEPPING MOTOR | MOVING BLADE POSITION SWITCHING FOURTH STEPPING MOTOR |
|---|---|---|---|---|
| OVER-EDGE CHAIN STITCH (WITH CLOTH BEING CUT) | DRIVE | DRIVE | STOP AT STOP POSITION | STOP AT CAM CONTACT POSITION |
| OVER-EDGE CHAIN STITCH (WITHOUT CLOTH BEING CUT) | DRIVE | DRIVE | STOP AT STOP POSITION | STOP AT FIRST CAM NON-CONTACT POSITION |
| DOUBLE-CHAIN STITCH (WITH CLOTH BEING CUT) | DRIVE | STOP AT STOP POSITION | DRIVE | STOP AT CAM CONTACT POSITION |
| DOUBLE-CHAIN STITCH (WITHOUT CLOTH BEING CUT) | DRIVE | STOP AT STOP POSITION | DRIVE | STOP AT SECOND CAM NON-CONTACT POSITION |

FIG.14B

OVER-LOCK SEWING MACHINE

BACKGROUND OF THE INVENTION

1. Field of the Invention

This invention relates to an over-lock sewing machine including sewing needles attached to a lower end of a needle bar and upper and lower loopers forming stitches in cooperation with the needles.

2. Description of the Related Art

Over-lock sewing machines are generally provided with a fixed blade and a moving blade in addition to needles and upper and lower loopers. Ends of a workpiece cloth to be sewn are cut by the fixed and moving blades immediately before a sewing operation. In conventional over-lock sewing machines of the above-described type, the needles or needle bar, the upper and lower loopers and the fixed and moving blades are usually driven by a single sewing machine motor. The over-lock sewing machine forms stitches on a cloth end by the needles and the upper and lower loopers, cutting the cloth end by the fixed and moving blades, thereby carrying out an over-edge chain stitch. The over-lock sewing machine also carries out a multi-thread chain stitch or double-chain stitch in which the lower looper is reciprocally moved back and forth between two Bides of the needles with the upper looper being stopped at a predetermined stop location.

Japanese Laid-open Patent Publication No. 62-16785 (1987) discloses one of the over-lock sewing machines constructed as described above. The disclosed over-lock sewing machine comprises an operation switching mechanism for switching the upper looper between a rockable state in which the upper looper is allowed to rock and a non-rockable state in which the upper looper is stopped at a stop location. The operation switching mechanism further switches the lower looper between a first state in which a reciprocal movement of the lower looper is disallowed and a second state in which the reciprocal movement of the lower looper is allowed. The operation switching mechanism includes a mechanism for coupling or decoupling a part of a transmission mechanism transmitting a driving force from a sewing machine motor to the upper and lower loopers, thereby switching, when an operation lever is operated, between the state in which the driving force from the motor is transmitted to the upper and lower loopers and the state in which the driving force is not transmitted to the upper looper.

Furthermore, Japanese Laid-open Patent Publication No. 7-659 (1995) discloses an over-lock sewing machine provided with an operation switching mechanism for switching between a state in which the upper looper is rockable and a state in which the upper looper is stopped at a stop location to thereby be non-rockable. The operation switching mechanism further switches the moving blade between an operative position where the driving force of the motor is transmitted to the moving blade so that the moving blade is moved upward and downward to thereby cut the cloth end in cooperation with the fixed blade, and an inoperative position where the driving force of the motor is not transmitted to the moving blade. This operation switching mechanism is provided with a mechanism for coupling or decoupling a part of a transmission mechanism transmitting a driving force from the motor to the upper looper and the moving blade when a switching lever is operated, thereby switching between the state in which the driving force from the motor is transmitted to the upper looper and the moving blade and the state in which the driving force is not transmitted to the moving blade.

In the over-lock sewing machines disclosed in the above-mentioned Japanese publications, the needle bar, the upper and lower loopers, and the moving blade are driven by a single motor. Accordingly, this driving manner requires the operation switching mechanism. However, the operation switching mechanism necessitates a large number of parts and accordingly has a complicated structure. The operating switching mechanism increases the sizes of the conventional over-lock sewing machines, resulting in an increase in the manufacturing cost of the sewing machines. Furthermore, adjusting an amount of operation and operation timings of the upper and lower loopers etc. driven by the single motor is difficult. Moreover, in the over-lock sewing machine disclosed in publication No. 7-659, the moving blade is also switched from the operative position to the inoperative position when the upper looper is switched from the rockable state to the non-rockable state. Accordingly, execution of the over-edge chain stitch is always accompanied by the cutting of the cloth end, whereas the double-chain stitch is always executed without cutting the cloth end. Consequently, the over-edge chain stitch cannot be executed without cutting the cloth end, and the double-chain stitch cannot be executed with the cloth end being cut.

SUMMARY OF THE INVENTION

Therefore, an object of the present invention is to provide an over-lock sewing machine wherein the upper and lower loopers and the moving blade are driven by motors other than the sewing machine motor so that the amounts of operation and operation timings of the upper and lower loopers can readily be adjusted.

Another object of the invention is to provide an over-lock sewing machine wherein the lower looper can be reciprocated back and forth by a motor other than the sewing machine motor, the moving blade can be switched between the operative and inoperative positions by a motor other than the sewing machine motor, the over-edge chain stitch can be executed without the cutting of the cloth end, and the double-chain stitch can be executed with the cloth end being cut.

The present invention provides an over-lock sewing machine comprising a sewing machine motor for driving a needle bar so that the needle bar is moved upward and downward, a sewing needle mounted on a lower end of the needle bar, an upper looper and a lower looper forming stitches in cooperation with the sewing needle, and an upper looper rocking stepping motor for driving the lower looper so that the lower looper is rocked.

According to the above-described over-lock sewing machine, the lower looper is driven by a motor other than the sewing machine motor. Consequently, an amount of operation and an operation timing of the lower looper can readily be adjusted. Furthermore, since no complicated operation switching mechanism is required, the construction of the over-lock sewing machine can be simplified.

In a preferred form, the over-lock sewing machine further comprises an upper looping rocking stepping motor for driving the upper looper so that the upper looper is rocked. In another preferred form, the sewing machine further comprises a lower upper reciprocating stepping motor for driving the lower looper so that the lower looper is reciprocated back and forth between opposite sides of the needle. In further another preferred form, the sewing machine further comprises a fixed blade, a moving blade driven upward and downward by the sewing machine motor to thereby cut an end of a workpiece cloth to be sewn in cooperation with the fixed blade immediately before a sewing operation, and a moving blade position switching mechanism for switching the moving blade between an operative position where the moving blade is permitted to cut the cloth end in cooperation with the fixed blade and an inoperative position where a driving force from the sewing machine motor is not transmitted to the moving blade. In further another preferred form, the sewing machine preferably further comprises a sewing bed. In this construction, the inoperative position of the moving blade is preferably selectable to be either a first inoperative position where the moving blade projects from an upper face of the sewing bed in an over-edge chain stitch mode or; and a second inoperative position where the moving blade is retracted inside the sewing bed in a double-chain stitch mode.

In further another preferred form, the sewing machine preferably further comprises a driving shaft and a cam secured to the driving shaft. In this construction, the moving blade position switching mechanism preferably includes a rocking motion transfer member engaging the cam to thereby transfer a driving force to the moving blade, and a transfer member moving stepping motor for moving the rocking motion transfer member to a position where the rocking motion transfer member is in disengagement from the cam. Furthermore, the sewing machine preferably further comprises a control section for controlling the fifth to fourth stepping motors, a first switch electrically connected to the control section for switching the upper looper rocking stepping motor between an operative state and an inoperative state, and a second switch electrically connected to the control section for switching the transfer member moving and stepping motor between an operative position and an inoperative position. Additionally, the sewing machine preferably further comprises a fixed blade, a moving blade for cutting an end of a workpiece cloth to be sewn in cooperation with the fixed blade, and a blade driving stepping motor for driving the moving blade upward and downward.

BRIEF DESCRIPTION OF THE DRAWINGS

Other objects, features and advantages of the present invention will become clear upon reviewing the following description of the preferred embodiments thereof, made with reference to the accompanying drawings, in which:

FIGS. 14A and 14B show sewing modes executed by the over-lock sewing machine;

DETAILED DESCRIPTION OF THE PREFERRED EMBODIMENTS

Figure 1:
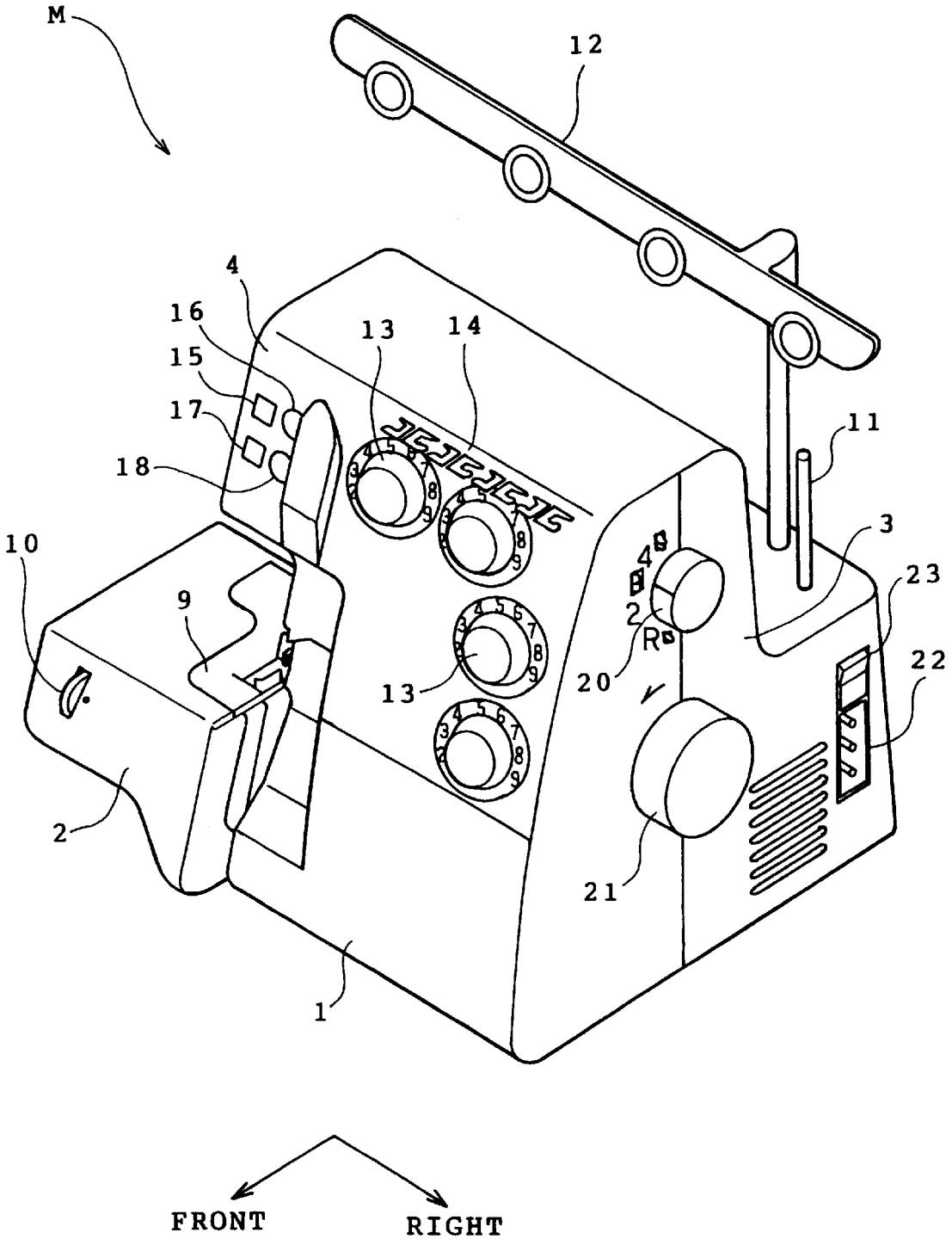
FIG. 1 is a perspective view of the over-lock sewing machine of a first embodiment in accordance with the present invention.

A first embodiment of the present invention will be described with reference to FIGS. 1 to 22. In the first embodiment, the invention is applied to an over-lock sewing machine which can execute an over-edge chain stitch and a double-chain stitch. Referring to FIGS. 1 to 6, the over-lock sewing machine M of the first embodiment comprises a sewing bed 1, a pedestal 3 standing from a right-hand portion of the sewing bed 1, and a sewing arm 4 extending leftward from an upper end of the pedestal 3. The sewing bed 1, the pedestal 3 and the sewing arm 4 constitute a sewing machine body. A left-hand end of the bed 1 serves as a cantilevered free bed 2 or free arm. In the bed 1 are provided lower and upper loopers 5 and 6, a main feed dog and differential feed dog (neither shown), and fixed and moving blades 7 and 8 cutting an end of a workpiece cloth to be sewn immediately before a sewing operation. A throat plate 9 is provided on an upper face of the free bed 2. The lower looper 5 is disposed near the backside of the throat plate 9. The upper looper 6 is disposed so as to project through the right-hand side of the throat plate 9 thereabove. The moving blade 8 is disposed to project from the throat plate 9 in the right of the latter and to be vertically movable. The main feed dog and the differential feed dog are disposed to project through an elongated hole 9*a* (see FIG. 5) formed in the throat plate 9.

A part of a dial member 10 projects from a front side of the free bed 2. The dial member 10 is rotated so that an amount of differential feed of the differential feed dog relative to the main feed dog is adjusted. Four spool holders 11 and a thread guide 12 stand from the rear upper face of the bed 2. Four thread tension discs 13 are provided on the front faces of the pedestal 3 and the arm 4. Thread guides 14 are provided on the upper end of the pedestal 3. Four threads extending from four thread spools attached to the spool holders 11 respectively are guided by a thread guide member 12. The threads are supplied to a pair of sewing needles 25 and the lower and upper loopers 5 and 6 through the thread guides 14 and the thread tension discs 13 respectively.

Figure 2:
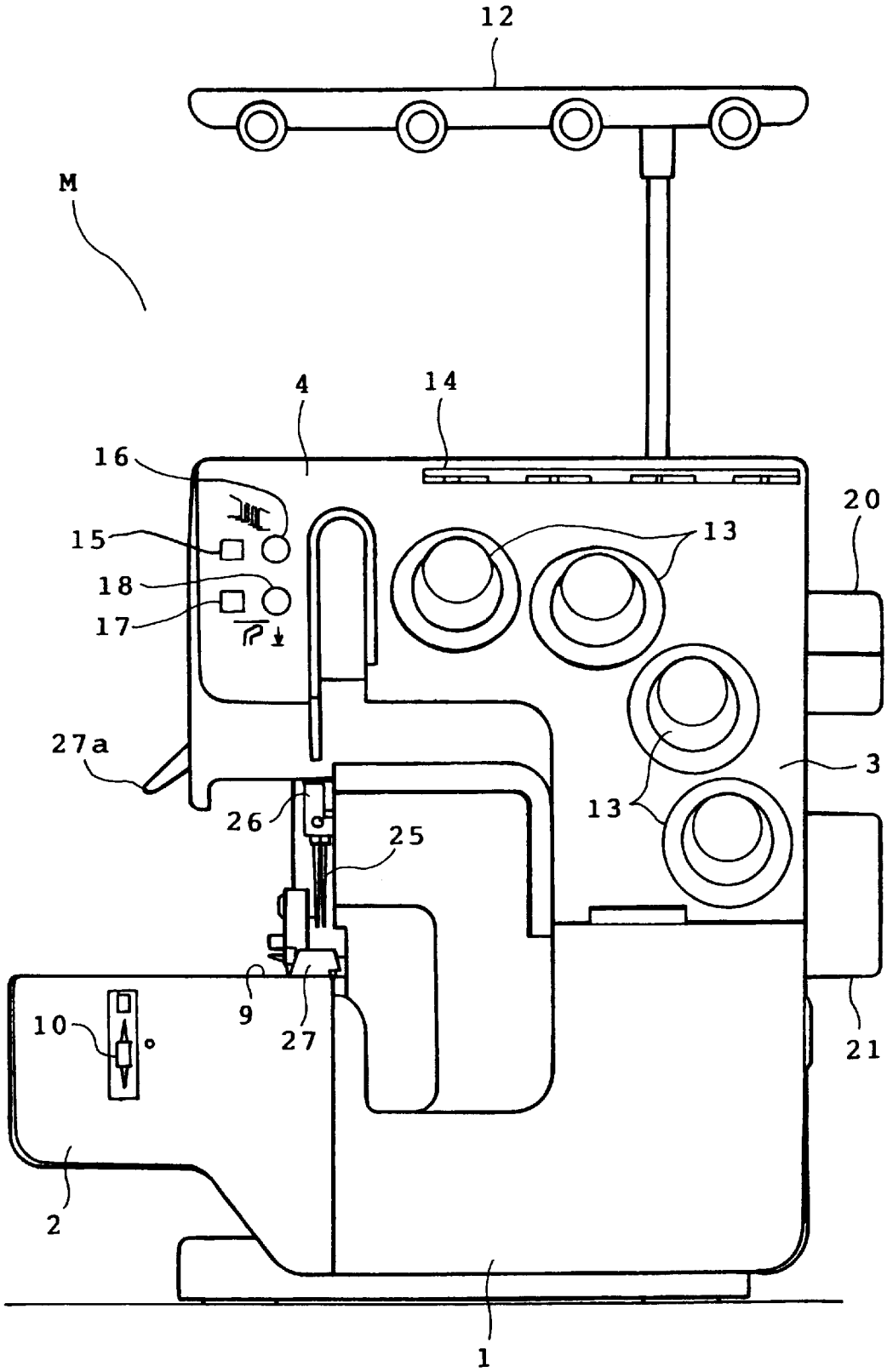
FIG. 2 is a front view of the over-lock sewing machine.
Figure 3:
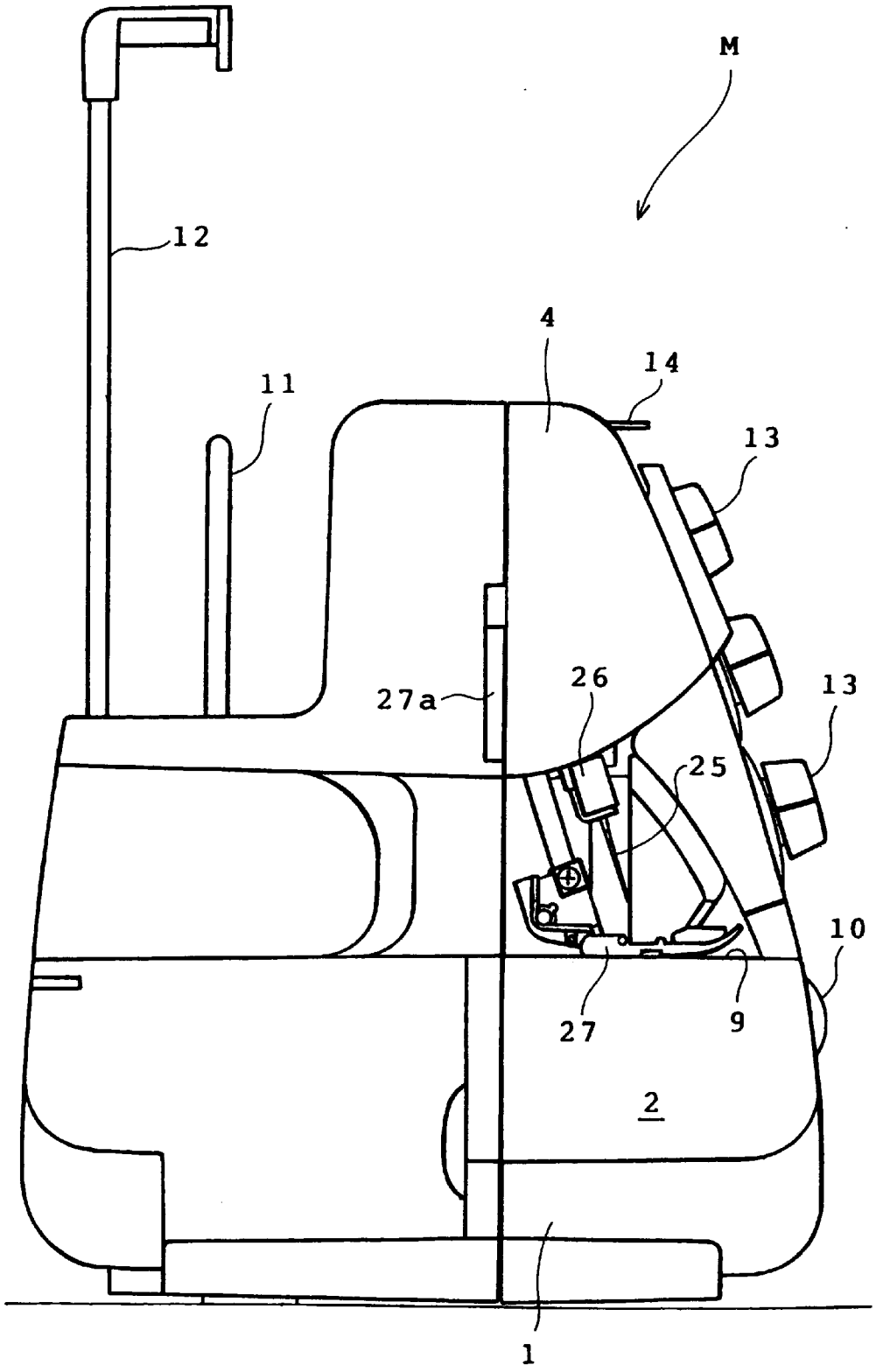
FIG. 3 is a left-hand side view of the over-lock sewing machine.
Figure 24:
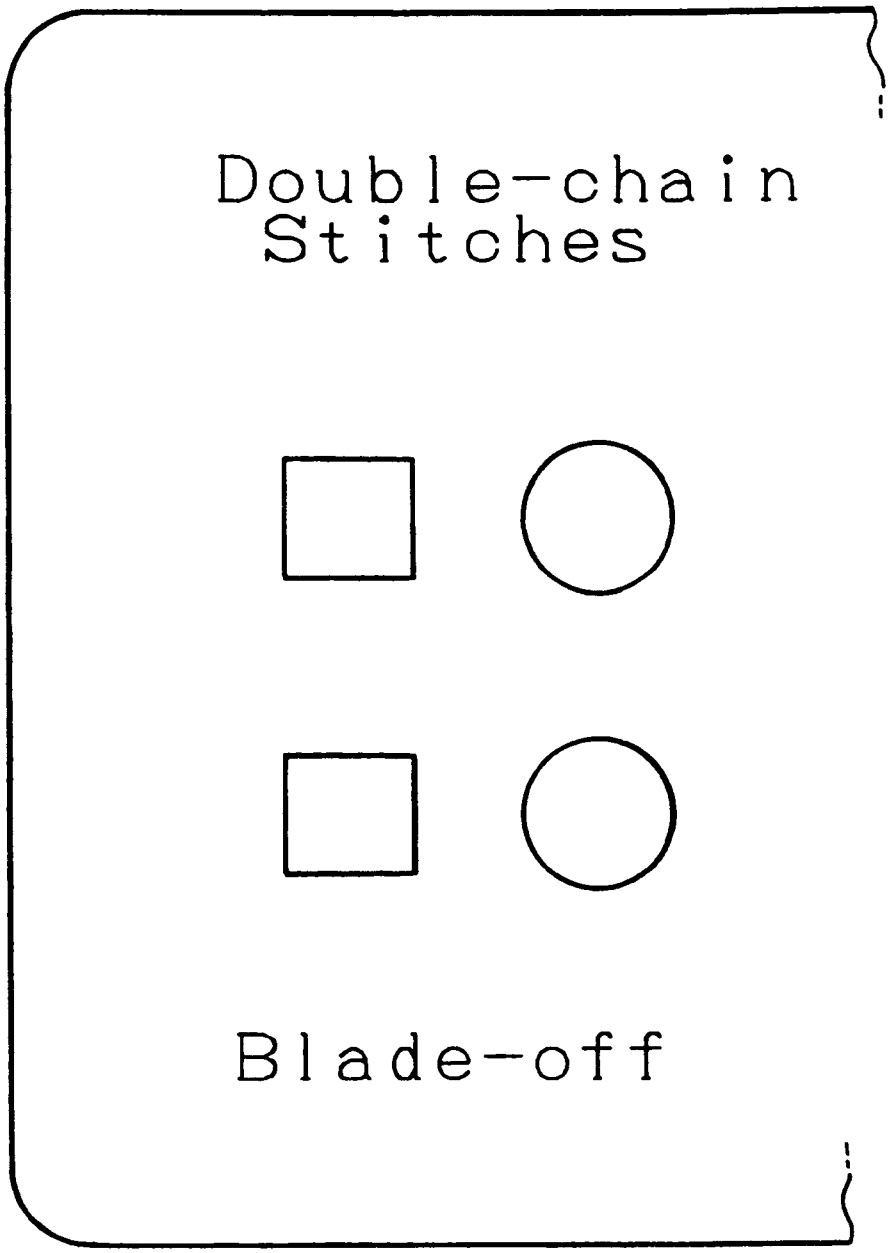
FIG. 24 is a partial front view of first and second switches and peripheral parts, showing a modified form.

A left-hand front face of the arm 4 is provided with a first switch 15, a double-chain stitch LED 16 emitting light when the first switch 15 is turned on, a second switch 17, and a moving blade LED 18 emitting light when the second switch 17 is turned on. The sewing machine M can execute the over-edge chain stitch when the first switch 15 is turned off, whereas it can execute the double-chain stitch when the first switch 15 is turned on. Furthermore, the moving blade 8 is driven vertically when the second switch 17 is turned off. When the second switch 17 is turned on and the sewing machine M is in the over-edge chain stitch mode, that is, the first switch 15 is turned off, the moving blade 8 is moved to a first inoperative position where the moving blade projects from the upper face of the bed 2. When the second switch 17 is turned on and the sewing machine is in the double-chain stitch mode, that is, the first switch 15 is turned on, the moving blade 8 is moved to a second inoperative position where the moving blade is retracted inside the bed 2. A driving force from a sewing machine motor 35 is not transmitted to the moving blade 8 when the moving blade is at either inoperative position, so that the moving blade is not driven vertically. As shown in FIG. 2, the front face of the arm 4 carries an indicia representative of double-chain stitches near the first switch 15 and the double-chain stitch LED 16 (an upper portion in FIG. 2) The front face of the arm 4 further carries another indicia representative of inoperative state of the moving blade 8 near the second switch 17 and the moving blade LED 18 (a lower portion in FIG. 2). Although each indicia is an illustration in the embodiment, characters such as "double-chain stitches" and "blade-off" may be provided on the front face of the arm 4 as shown as a modified form in FIG. 24, instead.

A right-hand side of the bed 1 and pedestal 3 is provided with a feed amount adjusting knob 20, a rotary operation member 21 directly connected to a right-hand end of a driving shaft 36, an electrical connector 22 to which a power-supply side connector (not shown) is connectable, and a power-supply switch 23. The feed amount adjusting knob 20 is rotated to adjust an amount of forward and backward feed of the feed dog. The rotary operation member 21 is rotated to rotate the driving shaft 36. As shown by chain line in FIG. 4, a connecting code 28*a* connected at its; one end to a control section 90 (see FIG. 10) inside the bed 1 extends from the latter. The other end of the connecting code 28*a* is connected to a foot controller 28.

The arm 4 includes a needle bar 26 having the lower end to which a pair of needles 25 are attached, a presser foot 27 for pressing the workpiece cloth, a switching lever 27*a* for switching the presser foot 27 between a lower position and an upper position, and a thread take-up lever (not shown). When the presser foot 27 is switched to the lower position by the switching lever 27*a,* the workpiece cloth is pressed against the throat plate 9 by the presser foot 27. When the feed dog is fed in this state, the workpiece cloth is fed in a feeding direction (forward and backward), being held between the feed dog and the presser foot 27.

Figure 4:
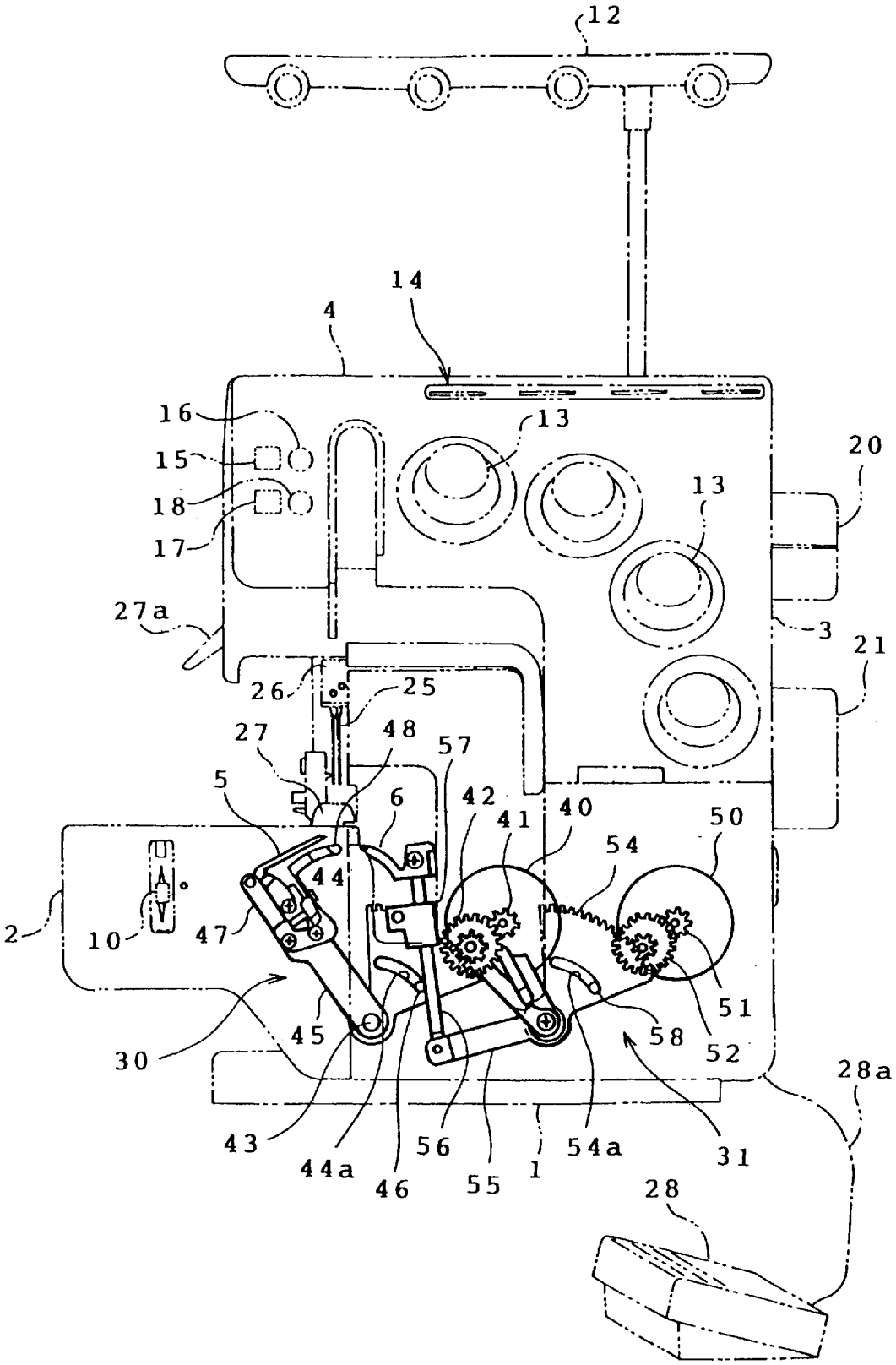
FIG. 4 is a front view of the inner mechanisms of the over-lock sewing machine.
Figure 5:
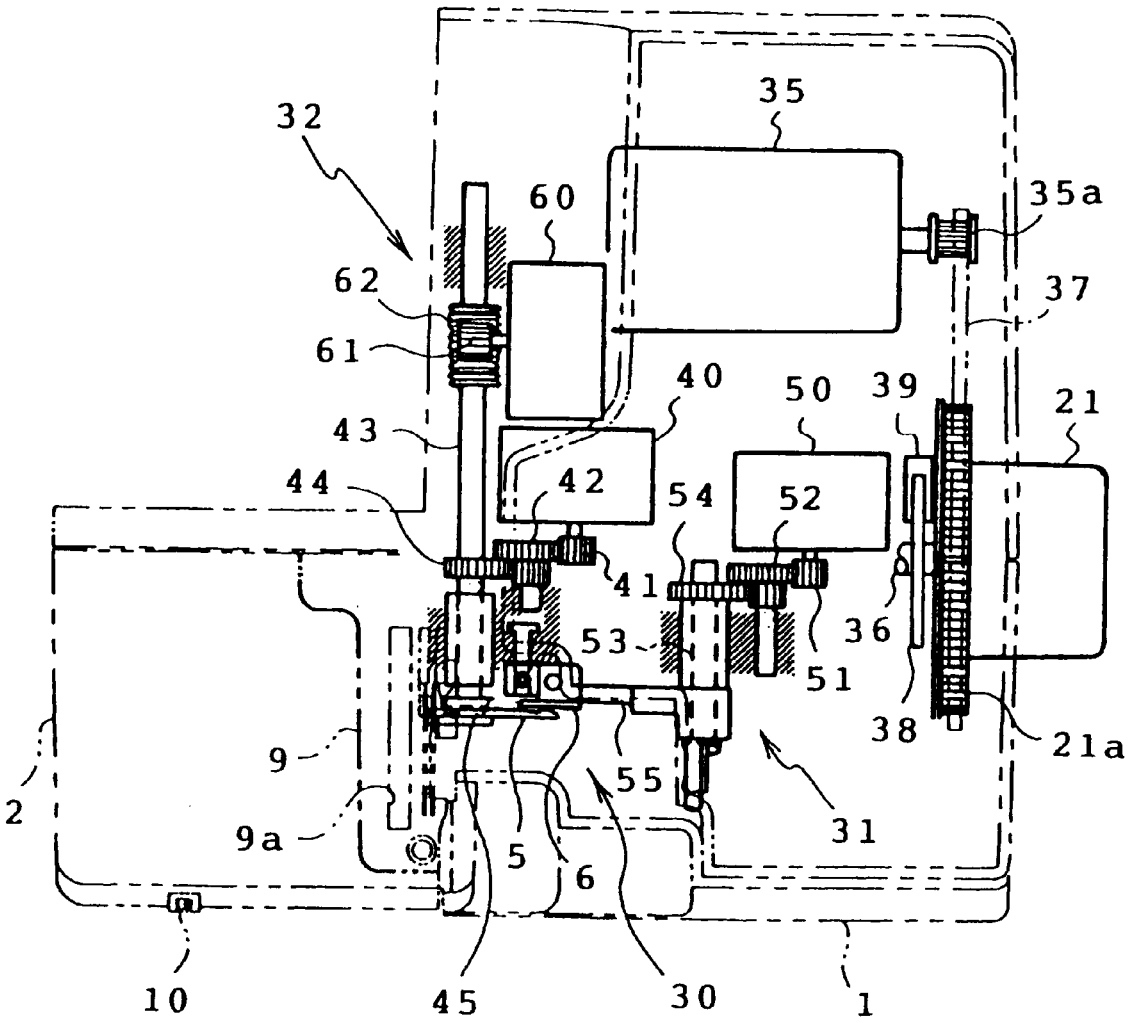
FIG. 5 is a plan view of the inner mechanisms of the over-lock sewing machine.
Figure 6:
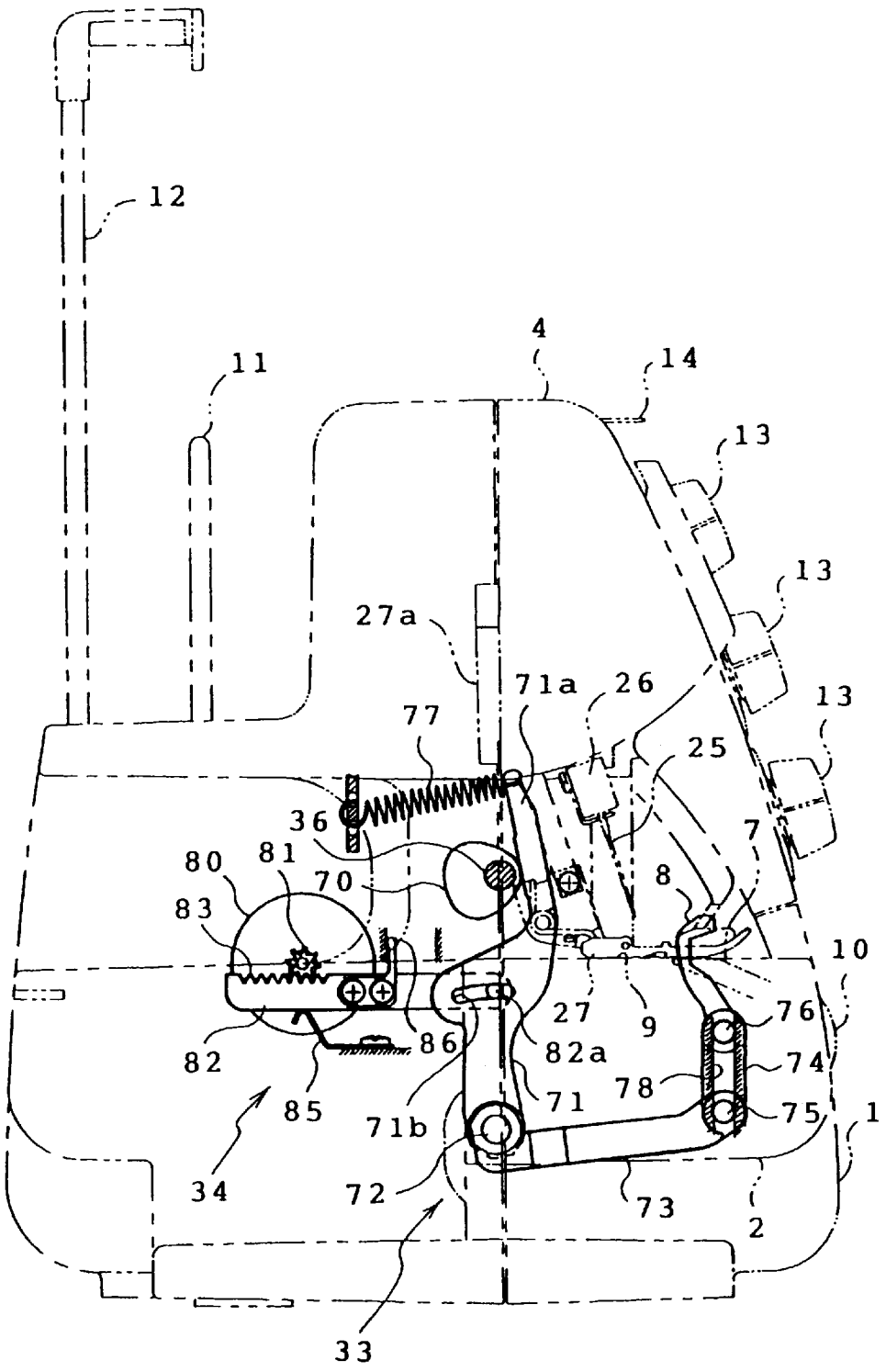
FIG. 6 is a left-hand side view of the inner mechanisms of the over-lock sewing machine.

Referring to FIGS. 4 to 6, inside the sewing machine M are provided a lower looper rocking mechanism 30 for rocking the lower looper 5, an upper looper rocking mechanism 31 for rocking the upper looper 6, and a lower looper forward and backward driving mechanism 32 for driving the lower looper 5 so that the lower looper 5 is reciprocated back and forth between the front and rear sides of the needles 25. Inside the sewing machine M are also provided a moving blade vertically driving mechanism 33 for vertically driving the moving blade 8 and a moving blade position switching mechanism 34 for switching the moving blade 8 between an operative position where the moving blade is capable of cutting the cloth end in cooperation with the fixed blade 7 and an inoperative position where the driving force from the sewing machine motor 35 is not transmitted to the moving blade 8. Inside the sewing machine M are further provided a needle bar driving mechanism (not shown) for driving the needle bar 26 and the thread take-up lever and a feed dog forward and backward feeding mechanism (not shown) for feeding the feed dog forward and backward. The sewing machine M is further incorporated with the sewing machine motor 35 common to the above-described mechanisms and the moving blade vertically driving mechanism 33, the driving shaft 36 (see FIG. 5) rotated in a predetermined direction by the motor 35, and a drive control section 90 (see FIG. 10) for controlling the motor 35 and four stepping motors 40, 50, 60 and 80.

Referring to FIG. 5, the rotary operation member 21 directly connected to the right-hand end of the driving shaft 36 has an integrally formed driven pulley 21*a*. The motor 35 includes an output shaft to which a driving pulley 35*a* is secured. A toothed belt 37 extends between the driven pulley 21*a* and the driving pulley 35*a*. Upon drive of the motor 35, a driving force is transmitted via the driving pulley 35*a,* the toothed belt 37 and the driven pulley 21*a* to the driving shaft 36, thereby rotating the latter. A disk 38 with a plurality of slits is secured to the driving shaft 36. An optical sensor 39 is fixed to a machine frame (not shown) and comprises at least two pairs of light-emitting section and light-receiving section disposed at opposite sides of the disk 38. The disk 38 and the optical sensor 39 are provided for detecting a home position of the driving shaft 36 and a rotational position thereof relative to the home position. Description of the needle bar driving mechanism, the feed dog forward and backward driving mechanism and the feed dog vertically driving mechanism will be eliminated.

The lower looper rocking mechanism 30 will now be described. As shown in FIGS. 4 and 5, the lower looper rocking mechanism 30 includes the first stepping motor 40, a driving gear 41 secured to an output shaft of the first stepping motor 40, a combined gear assembly 42 including a largest-diameter gear meshing the driving gear 41 and pivotally mounted on the machine frame, a sector gear 44 meshing a smallest-diameter gear of the combined gear assembly 42 and secured to a middle portion of a pivot shaft 43, and a lower looper link 45 secured to a forward end of the pivot shaft 43. The lower looper 5 is provided integrally with a distal end of the lower looper link 45. The pivot shaft 43 is supported at both front and rear ends thereof on the machine frame for rotation and for forward and rearward movement. The sector gear 44 is formed with an arcuate slit 44*a* in the range of 45 degrees about the pivot shaft 43. An engagement pin 46 fixedly provided on the machine frame engages the slit 44*a*, whereby the sector gear 44 is rotatable in the range of about 45 degrees.

Upon drive of the first stepping motor 40, the sector gear 44, the pivot shaft 43 and the lower looper link 45 are rocked via the driving gear 41 and the combined gear 42, and the lower looper is arcuately reciprocated. The lower looper link 45 is provided with a thread guide plate 47 guiding the threads extending from the thread tension discs 13 to the lower looper 5 and a guide bar 48 guiding and protecting the needles 25.

The upper looper rocking mechanism 31 will now be described. Referring to FIGS. 4 and 5, the upper looper rocking mechanism 31 comprises the second stepping motor 50, a driving gear 51 secured to an output shaft of the second stepping motor 50, a combined gear assembly 52 including a largest diameter gear meshed with the driving gear 51 and pivotally mounted on the machine frame, a sector gear 54 meshing a smallest diameter gear of the combined gear assembly 52 and secured to a rear end of a pivot shaft 53, an upper looper link 55 secured to a forward end of the pivot shaft 53, a rod 56 rotatably connected to a distal end of the upper looper link 55, and a guide member 57 which is pivotally mounted on the machine frame and through which the rod 56 is inserted and guided. The upper looper 6 is provided integrally on a distal end of the rod 56. The sector gear 54 is formed with an arcuate slit 54*a* in the range of 45 degrees about the pivot shaft 53. An engagement pin 58 fixedly provided on the machine frame engages the slit 54*a*, whereby the sector gear 54 (the upper looper link 55) is rotatable in the range of about 45 degrees.

Upon drive of the second stepping motor 50, the sector gear 54 and the upper looper link 55 are rocked via the driving gear 51 and the combined gear assembly 52. As a result, the rod 56 guided by the guide member 57 is irregularly moved 60 that the upper looper 6 is reciprocated along an about quarter elliptic curve so as to substantially cross a locus of the needles 25 over the throat plate 9.

The lower looper forward and backward driving mechanism 32 will be described. Referring to FIG. 5, the lower looper forward and backward driving mechanism 33 comprises a third stepping motor 60, a pinion 61 secured to an output shaft of the third stepping motor 60, and the pivot shaft 43 common both to the lower looper rocking mechanism 30 and to the driving mechanism 32. The driving mechanism 32 further comprises a cylindrical rack member 62 which is secured to the pivot shaft 43 and with which the pinion 61 meshes. The rack member 62 has its teeth formed at least in the range of about 45 degrees about an axis of the pivot shaft 43 so as to cross the axis. Consequently, the pivot shaft 43 is rotatable when the pinion 61 meshes with the rack member 62. Upon drive of the third stepping motor 60, the lower looper 5 is reciprocated between the forward and rear sides of the needles 25 together with the pivot shaft 43 via the pinion 61 and rack member 62.

The moving blade vertically driving mechanism 33 will now be described. Referring to FIGS. 6 to 9, the moving blade vertically driving mechanism 33 comprises the driving shaft 36, a moving blade cam 70 secured to the driving shaft 36, a rocking motion transfer member 71 engaging the moving blade cam 70. The driving mechanism 33 further comprises a pivot shaft 72 to which a lower end of the transfer member 71 is secured and which is rotatably supported on the machine frame. The driving mechanism 33 further comprises a rocking link member 73 secured to the pivot shaft 72 and extending forward, and a moving member 74 rotatably connected via a pin 75 to a front end of the rocking link member 73. The lower end of the moving blade 8 is secured to an upper end of the moving member 74. The rocking motion transfer member 71 has an engagement strip 71*a* formed integrally therewith so as to upwardly extend in front of the moving blade cam 70. An upper end of the engagement strip 71*a* is connected via a tension coil spring 77 to a part of the machine frame at the rear of the moving blade cam 70. As a result, the rocking motion transfer member 71 is urged to rotate counterclockwise about the axis of the pivot shaft 72 and usually abuts the moving blade cam 70 at the front side. A guide pin 76 is provided on the lower end of the moving blade 8 or the upper end of the moving member 74. The pin 75 and the guide pin 76 engage an elongated engagement hole 78 formed in the machine frame, so that the moving blade 8 is guided to be vertically moved.

Figure 7:
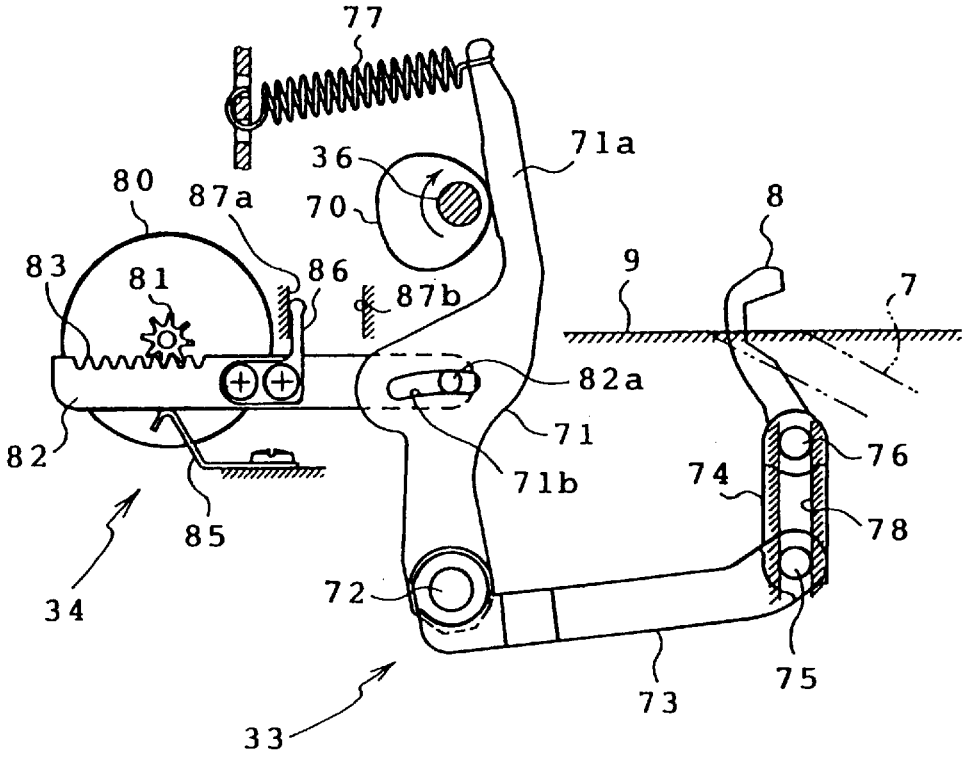
FIG. 7 illustrates a moving blade position switching mechanism in an operative state.
Figure 8:
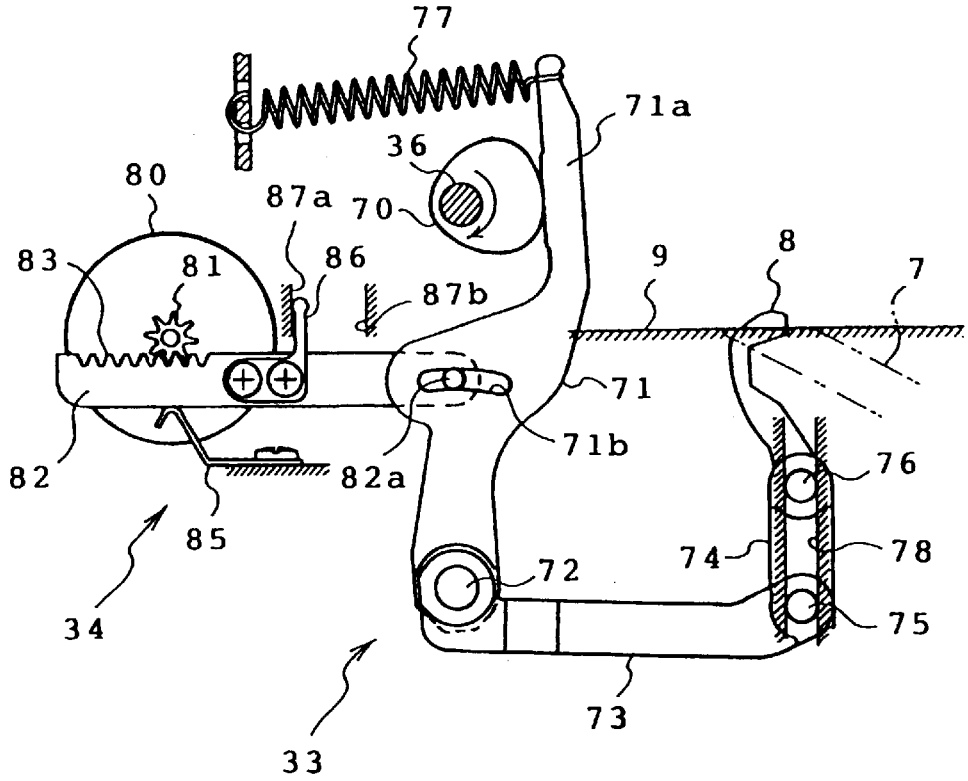
FIG. 8 illustrates the moving blade position switching mechanism in another operative state.

The moving blade cam 70 pushes the engagement strip 71*a* of the rocking motion transfer member 71 forward when the driving shaft 36 and the moving blade cam 70 are rotated in the direction of arrow in the state shown in FIG. 7. The rocking motion transfer member 71 is then rocked clockwise about the axis of the pivot shaft 72, so that the moving blade 8 is moved downward via the rocking link member 73 and the moving member 74 to assume the state as shown in FIG. 8. When the driving shaft 36 and the moving blade cam 70 are further rotated in the direction of arrow in the state of FIG. 8, the rocking motion transfer member 71 is rocked counterclockwise by an urging force of the tension coil spring 77, abutting the moving blade cam 70. Consequently, the moving blade 8 is moved upward via the rocking motion link member 73 and the moving member 74 to thereby assume the state of FIG. 7.

The moving blade position switching mechanism 34 will be described. Referring to FIGS. 6 to 9, the moving blade position switching mechanism 34 comprises the fourth stepping motor 80, a pinion 81 secured to an output shaft of the fourth stepping motor 80, and a pushing member 82 formed at its rear portion with a rack 83 the pinion 81 engages and having a distal end operatively connected to a lengthwise intermediate portion of the rocking motion transfer member 71. The pushing member 82 includes an engagement pin 82*a* formed on the distal end thereof. The engagement pin 82*a* engages an arcuate slit 71*b* formed in the rocking motion transfer member 71 about the pivot shaft 72. The pushing member 82 includes a leaf spring 85 provided on the rear backside thereof so as to be opposed to the pinion 81. The pushing member 82 is upwardly urged by the leaf spring 85 so that the pinion 81 reliably engages the rack 83. The pushing member 82 further includes a stopper 86 protruding upward at the lengthwise middle portion thereof. The stopper 86 is permitted to move back and forth between a pair of engagement portions 87*a* and 87*b* provided on the machine frame. The rocking motion transfer member 71 is rocked in abutment with the rotating moving blade cam 70 when the engagement pin 82*a* of the pushing member 82 engages an intermediate portion of the slit 71*b* of the rocking motion transfer member 71 with the stopper 86 abutting the engagement portion 87*a*, as shown in FIGS. 7 and 8. In other words, the moving blade 8 is driven vertically by the motor 35 and positioned so as to be able to cut a cloth end in cooperation with the fixed blade 7.

Figure 9:
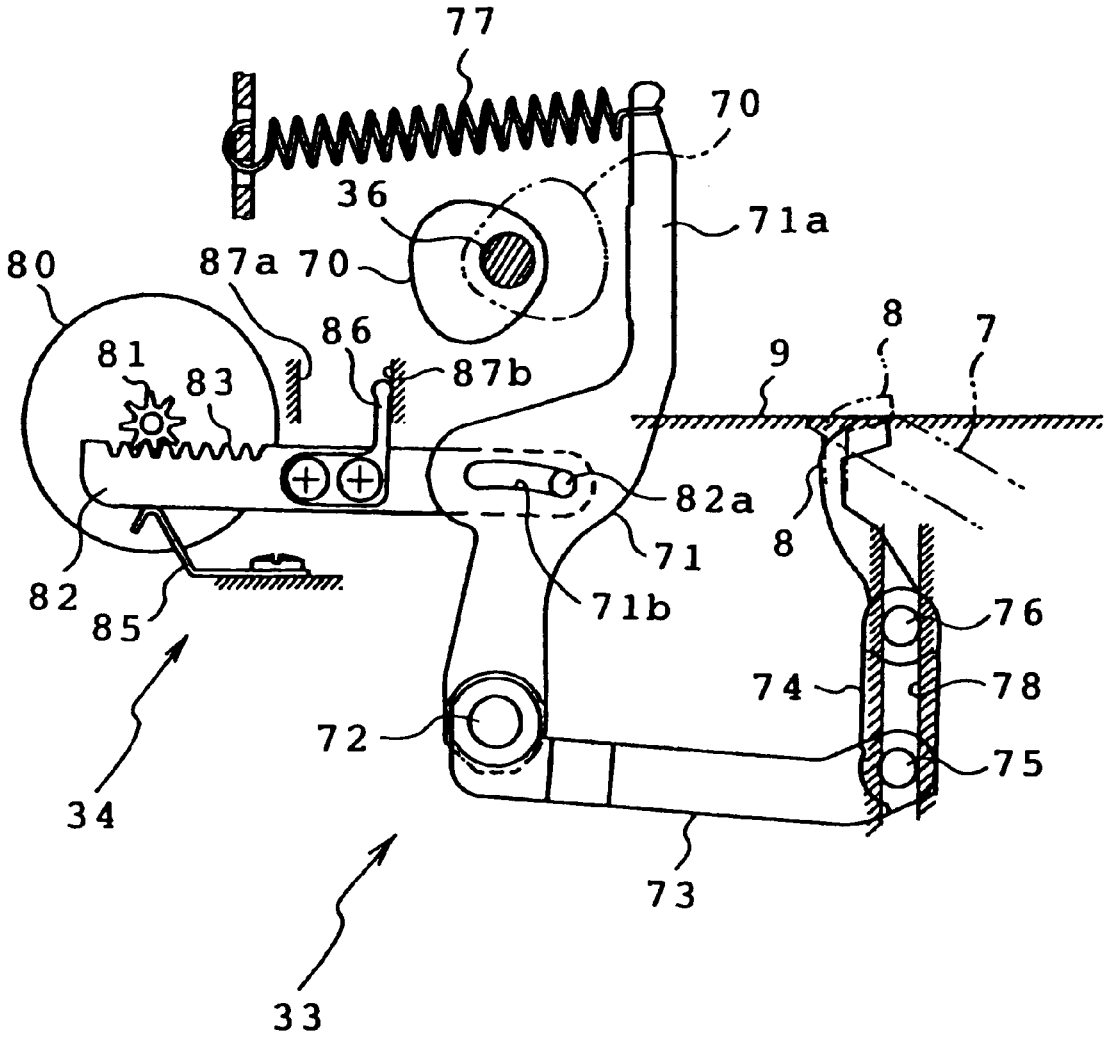
FIG. 9 illustrates the moving blade position switching mechanism in an inoperative state.

The stopper 86 is moved to the engagement portion 87*b* when the pushing member 82 is driven forward by the fourth stepping motor 80 in the state shown in FIG. 7 or 8. The engagement pin 82*a* abuts the front end of the slit 71*b* during the movement of the stopper 86 from its abutment with the engagement portion 87*a* to its abutment with the engagement portion 87*b*, as shown in FIG. 9, so that the rocking motion transfer member 71 is rotated clockwise about the axis of the pivot shaft 72. Consequently, the moving blade cam 70 is prevented from the contact with the engagement strip 71*a* of the rocking motion transfer member 71 even when rotated. Thus, the driving force of the motor 35 is not transmitted to the moving blade 8. At this time, the moving blade 8 is moved downward to a first inoperative position where it projects from the upper face of the bed 2 as shown in chain line in FIG. 9. When the stopper 86 is further moved forward to thereby abut the engagement portion 87*b*, the moving blade 8 is moved downward to a second inoperative position where it is retracted inside the bed 2.

Figure 10:
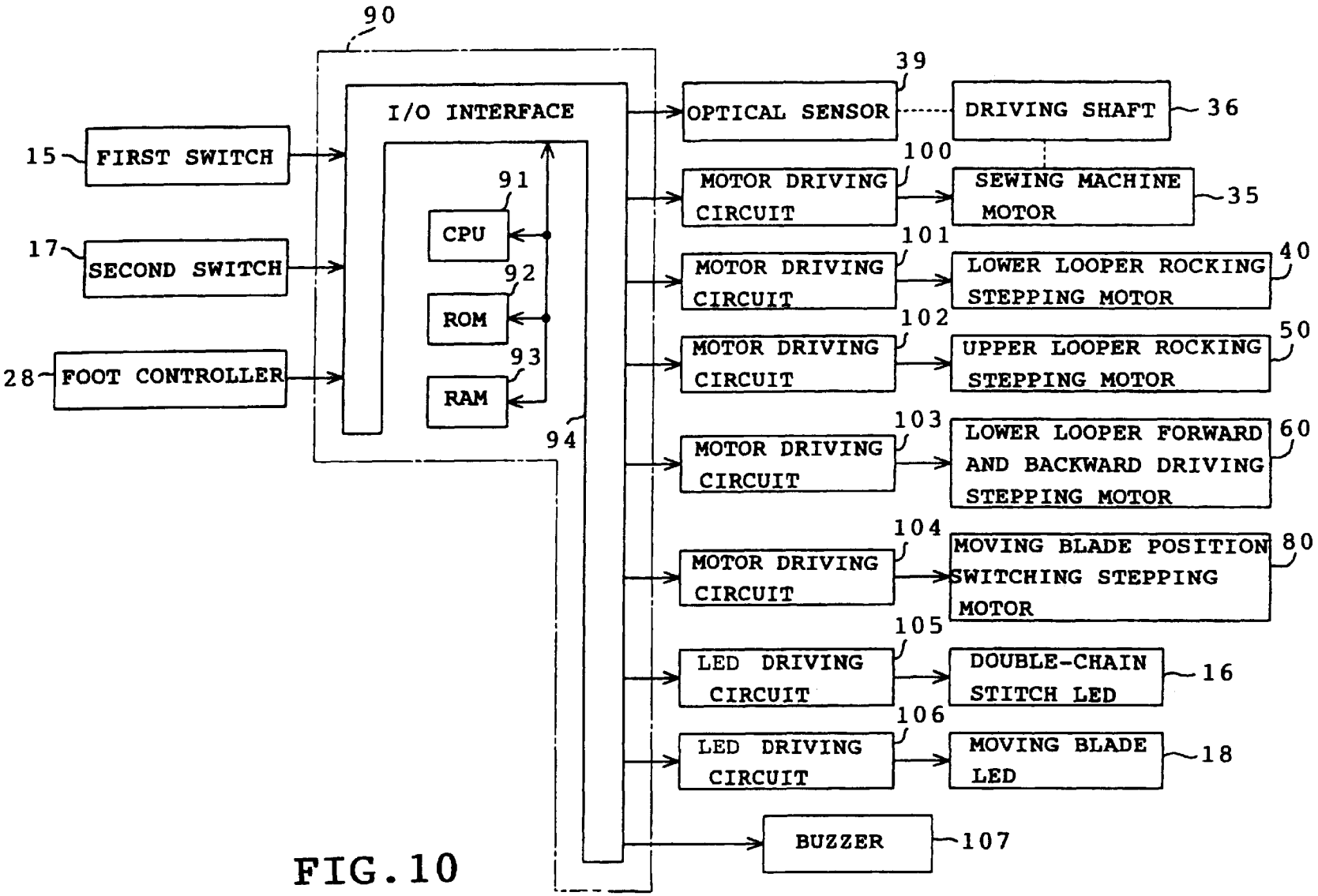
FIG. 10 is a block diagram showing a control system of the over-lock sewing machine.

A control system of the sewing machine M will now be described with reference to FIG. 10. A control section 90 controlling the overall operation of the sewing machine M comprises a CPU 91, a ROM 92, a RAM 93, and an input/output interface 94. The first and second switches 15 and 17, the foot controller 28, and the optical sensor 39 are connected to the input side of the input/output interface 94. Motor driving circuits 100 to 104, LED driving circuits 105 and 106, and a buzzer 107 are connected to the output side of the input/output interface 94. The sewing machine motor 35 and the stepping motors 40, 50, 60 and 80 are energized by the motor driving circuits 100 to 104 respectively. The double-chain stitch LED 16 and the moving blade LED 18 are energized by the LED driving circuits 105 and 106 respectively.

The ROM 92 stores an initial setting control program for controlling an initial setting of the motor 35 and the stepping motors 40, 50, 60 and 80, a flag setting control program for controlling the setting of a double-chain stitch flag and a moving blade flag by the first and second switches 15 and 17 respectively, and a motor control program for controlling the motor 35 and the stepping motors 40, 50, 60 and 80 on the basis of the double-chain stitch and moving blade flags, a command value delivered from the foot controller 28, a detection signal delivered from the optical sensor 39, etc.

Figure 11:
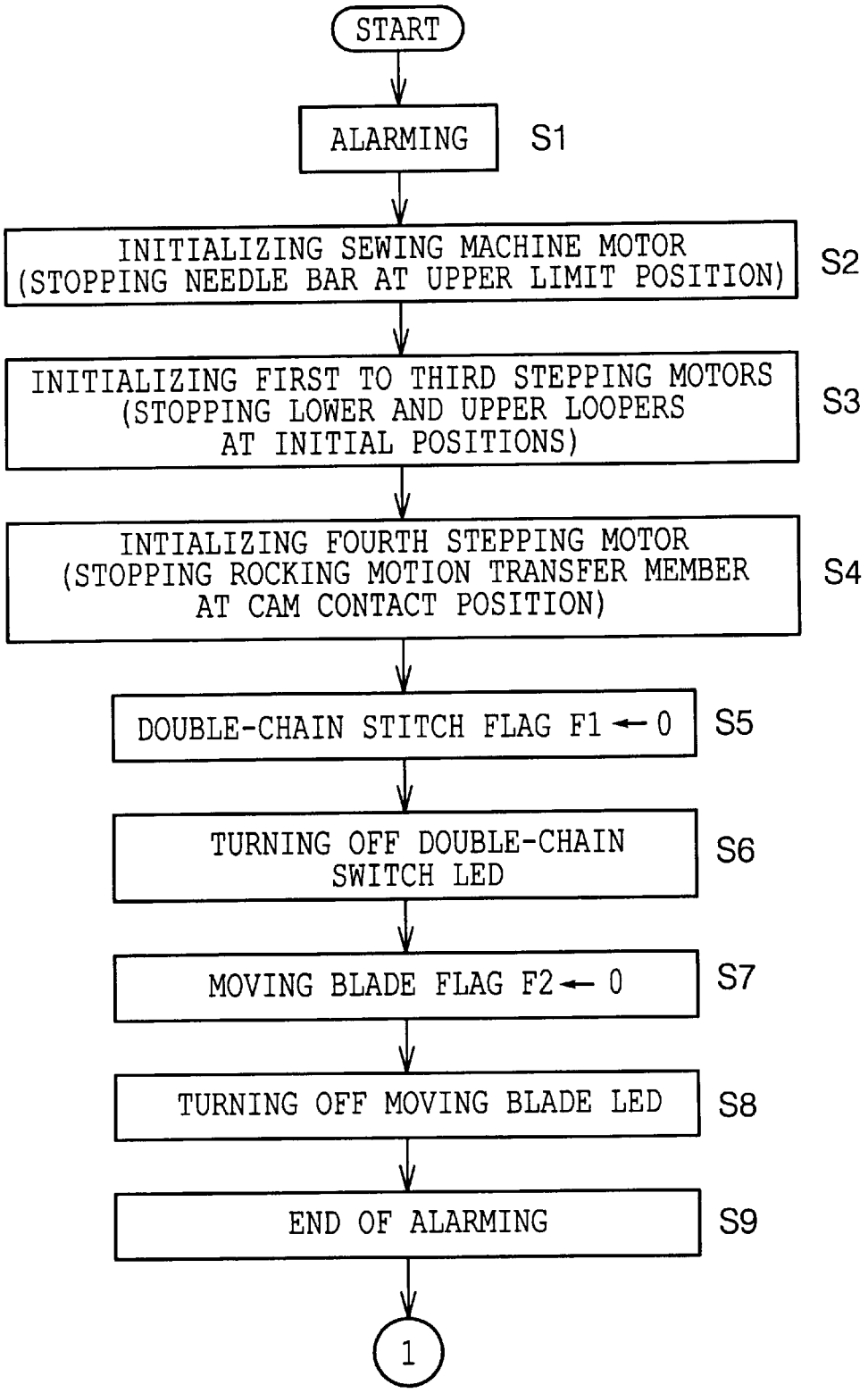
FIG. 11 is a flowchart showing the initial setting control.

The control including the above-mentioned initial setting control, the flag setting control and the motor control will be described with reference to FIGS. 11 to 13. Referring first to FIG. 11, the buzzer 107 is activated upon power supply to the sewing machine M (step S1). Then, the sewing machine motor 35 is initialized on the basis of the detection signal delivered from the optical sensor 39 such that the needle bar 26 (needles 25) is stopped at an upper limit position (step S2). The first to third stepping motors 40, 50 and 60 are then initialized such that the lower and upper loopers 5 and 6 are stopped at respective initial positions (step S3). Thereafter, the fourth stepping motor 80 is initialized such that the rocking motion transfer member 71 is stopped at a position where it is able to come into contact with the moving blade 70 (step s4). Each motor is driven at a predetermined low speed in the initial setting. Thereafter, the double-chain stitch flag F1 is reset to 0 (step S5) so that the multi-thread chain stitch LED 15 is turned off (step S6). Furthermore, the moving blade flag F2 is reset to 0 (step S7) so that the moving blade LED 18 is turned off (step S8). Then, the buzzer. 107 is deenergized (step S9). The overall initial setting processing is thus completed. The moving blade 8 assumes the operative position so as to be driven vertically when the driving force of the motor 35 is transmitted thereto.

Figure 12:
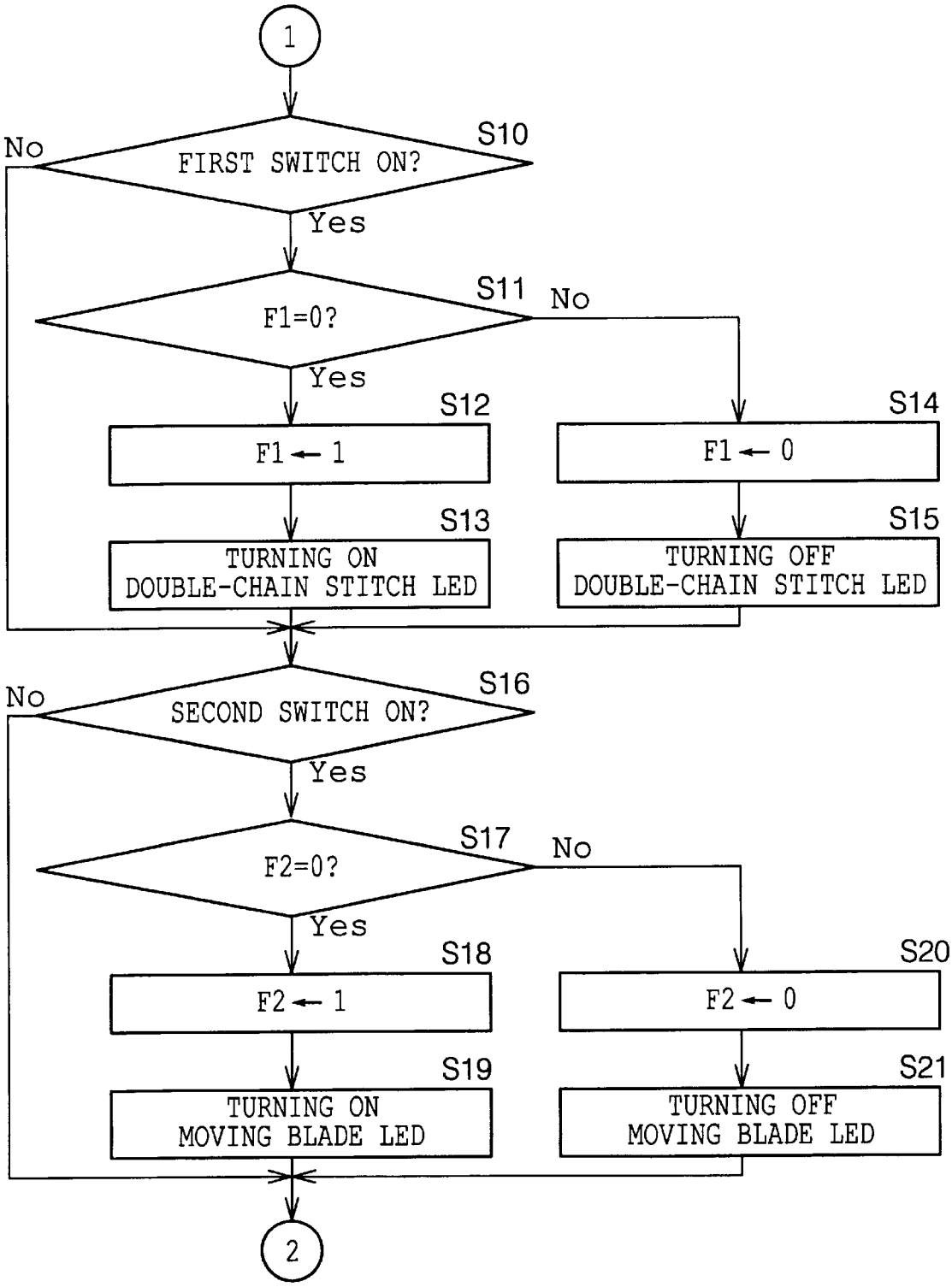
FIG. 12 is a flowchart showing the flag setting control.

After completion of the above-described initial setting, the control section 90 judges whether the first switch 15 is in an ON state (step S10) as shown in FIG. 12. When the first switch 15 is in the ON state (YES at step S10) and the double-chain stitch flag F1 has been reset (YES at step S11), the flag F1 is set (step S12) so that the double-chain stitch LED 16 is turned on to emit light (step S13). However, when having already been set (NO at step S11), the flag F1 is reset (step S14) so that the LED 16 is turned off (step S15).

When the first switch 15 is in an OFF state (NO at step S10), the control section 90 advances to step S16 to judge whether the second switch 17 is in the ON state. When the second switch 17 is in the ON state (YES at step S16) and the moving blade flag F2 has been reset (YES at step S17), the flag F2 is set (step S11) so that the moving blade LED 18 is turned on to emit light (step S19). However, when having already been set (NO at step S17), the flag F2 is reset (step S20) so that the LED 18 is turned off (step S21).

Figure 13:
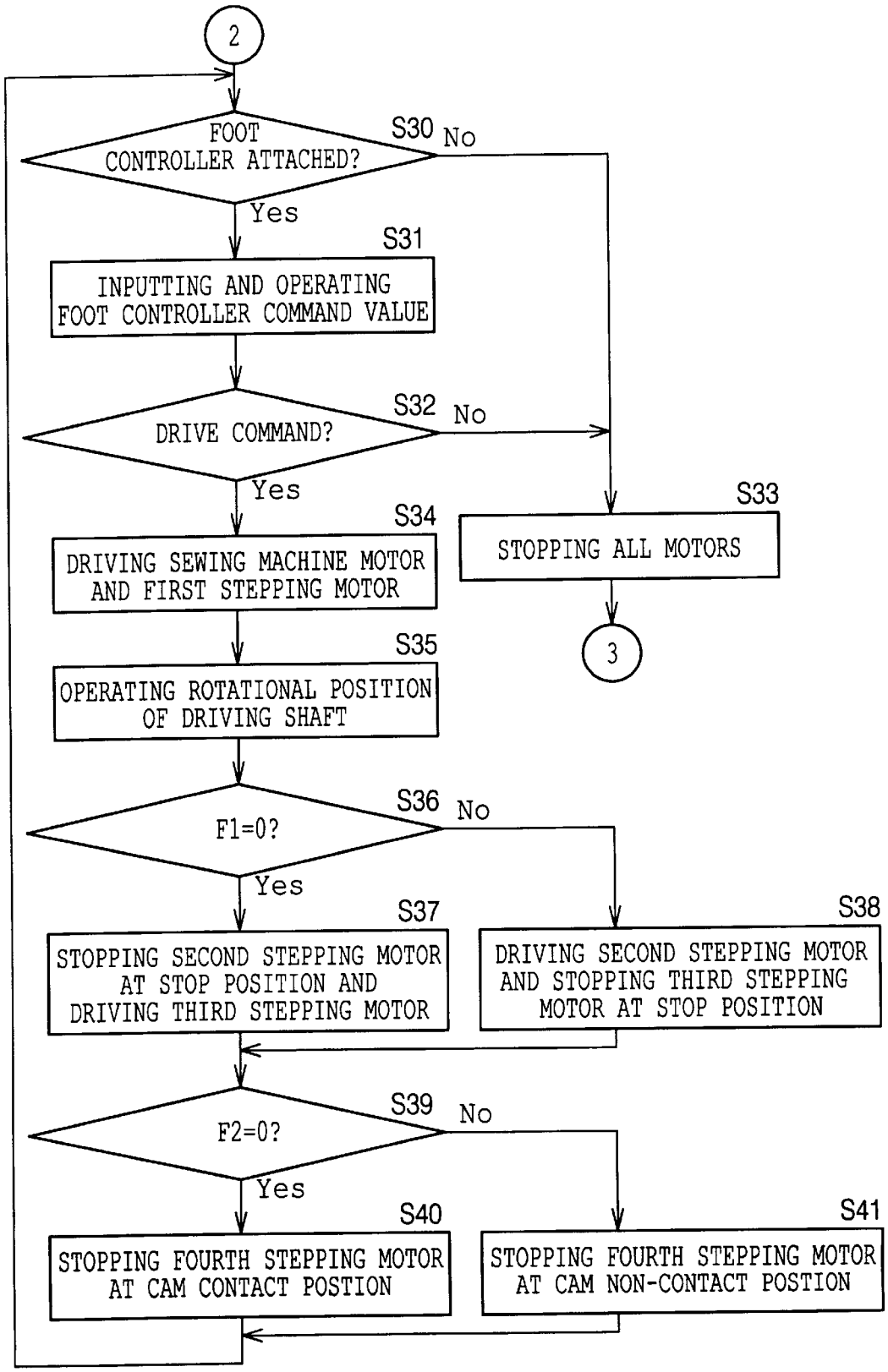
FIG. 13 is a flowchart showing the control for drive of the motors.

When the second switch 17 is in the OFF state (NO at step S16), the control section 90 advances to step S30 to judge whether the foot controller 28 is attached, as shown in FIG. 13. When the foot controller 28 is attached (YES at step S30), the control section 90 inputs a command value (for example, a resistance value in proportion to an amount of operation) from the foot controller 28, thereby judging by operation whether the command value is at or above a threshold for determination of a drive command (step S31). When the drive command is delivered on the basis of the operated command value (YES at step S32), the sewing machine motor and the first stepping motor 40 are driven on the basis of the drive command (step S34), and the rotational position of the driving shaft 36 is further operated on the basis of the detection signal delivered from the optical sensor 39 (step S35). On the other hand, when the foot controller 28 has not been operated so that the drive command is not delivered (NO at step S32), or when the foot controller 28 is not attached (NO at step S30), the control section 90 stops all the motors (step S33), thereafter advancing to step S10 (see FIG. 12).

The control section 90 stops the second stepping motor 50 at a predetermined stop position and drives the third stepping motor 60 (step S37) when the double-chain stitch flag F1 has been set (YES at step S36). On the other hand, when the flag F1 has been reset (NO at step S36), the control section 90 drives the second stepping motor 50 and stops the third stepping motor 60 at a predetermined stop position (step S38). The control section 90 then stops the fourth stepping motor 80 at a cam contact position (step S40) when the moving blade flag F2 has been reset (YES at step S39). When the flag F2 has been set (NO at step S39), the control section 90 stops the fourth stepping motor 80 at a cam non-contact position (step S41). At this time, when the double-chain stitch flag F1 has been set, the control section 90 stops the fourth stepping motor 80 at a second cam non-contact position where the moving blade 8 assumes the above-mentioned second inoperative position. On the other hand, when the flag F1 has been reset, the control section 90 stops the fourth stepping motor 80 at the second cam non-contact position where the moving blade 8 assumes the first inoperative position, thereafter returning to step 530.

When both the first and second switches 15 and 17 are turned off, the control section 90 drives the first and second stepping motors 40 and 50 and stops the third stepping motor 60 at the stop position and the fourth stepping motor 80 at the cam contact position, whereby the over-edge chain stitch can be executed with the cloth end being cut, as shown in FIGS. 14A and 14B. On the other hand, when the first switch is turned off and the second switch 17 is turned on, the control section 90 drives the first and second stepping motors 40 and 50 and stops the third stepping motor 60 at the stop position and the fourth stepping motor 80 at the first cam non-contact position, whereby the over-edge chain stitch can be executed without the cloth end being cut.

Furthermore, when the first switch 15 is turned on and the second switch 17 is turned off, the control section 90 drives the first and third stepping motors 40 and 60 and stops the second stepping motor 50 at the stop position and the fourth stepping motor 80 at the cam contact position, whereby the double-chain stitch can be executed with the cloth end being cut. On the other hand, when both the first and second switches 15 and 17 are turned on, the control section 90 drives the first and third stepping motors 40 and 60 and stops the second stepping motor 50 at the stop position and the fourth stepping motor 80 at the second cam non-contact position, whereby the double-chain stitch can be executed without the cloth end being cut.

Figure 15:
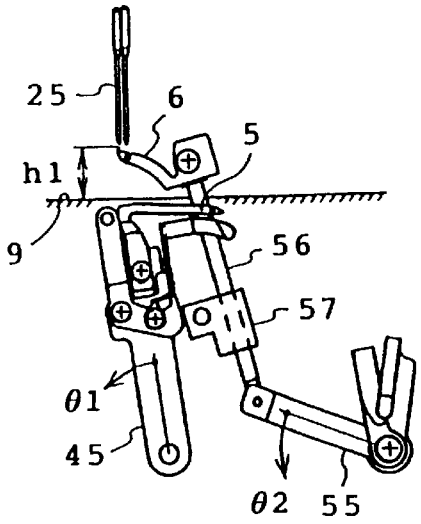
FIG. 15 is a front view of the needle, and the upper and lower loopers.
Figure 16:
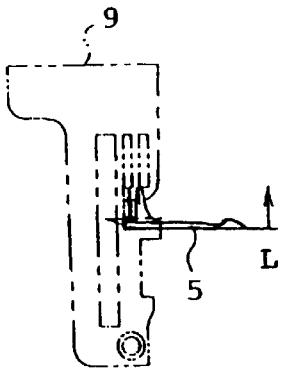
FIG. 16 is a plan view of the lower looper.
Figure 17:
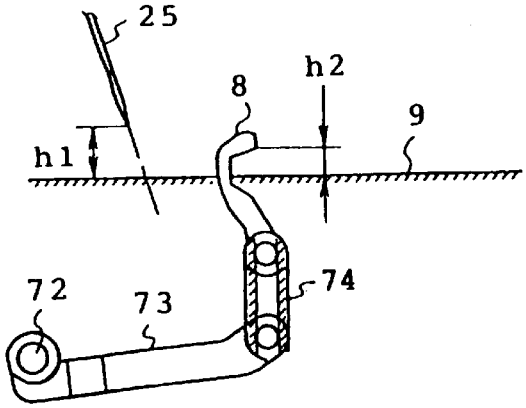
FIG. 17 is a left-hand side view of the needle and the moving blade.

The operations of the needles 25, the lower and upper loopers 5 and 6, and the moving blade 8 will be described in detail. In the following description, reference symbol h1 designates the height from the upper face of the throat plate 9 to the needle point, as shown in FIGS. 15 to 17. Reference symbol h2 designates the height from the upper face of the throat plate 9 to the edge of the moving blade 8. Reference symbol θ1 designates the counterclockwise rotation angle of the lower looper link 45 from the initialized position. Reference symbol θ2 designates the counterclockwise rotation angle of the upper looper link 55 from the initialized position. The rocking of the lower and upper loopers 5 and 6 will be described by way of the rocking of the lower and upper looper links 45 and 55.

Figure 18:
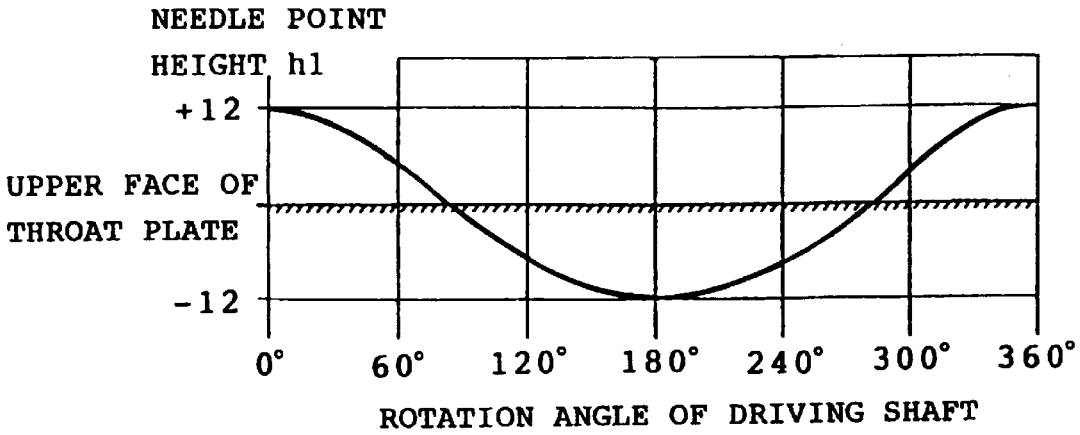
FIG. 18 is a graph showing the relationship between a rotation angle of the driving shaft and the level of the needle point.
Figure 19:
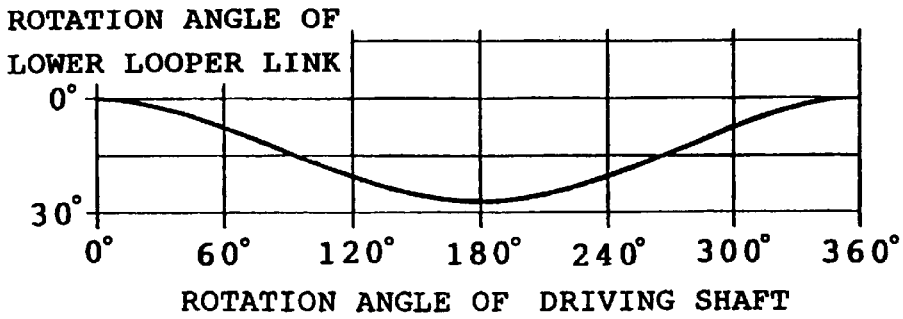
FIG. 19 is a graph showing the relationship between the rotation angles of the driving shaft and the lower looper.
Figure 20:
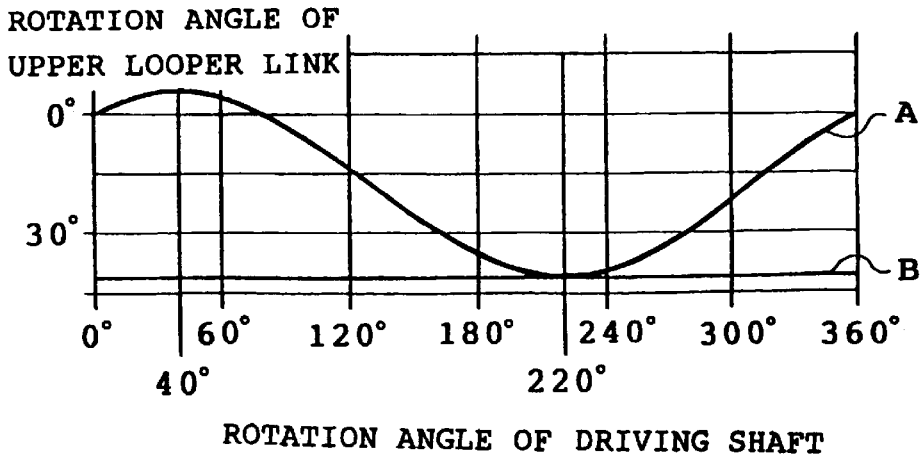
FIG. 20 is a graph showing the relationship between the rotation angles of the driving shaft and the upper looper link.

The height h1 of the needle point is represented by a sine curve with the amplitude of 22 mm as shown in FIG. 18. The rotation angle θ1 of the lower looper link 45 is represented by a sine curve with a maximum rotation angle of 30 degrees as shown in FIG. 19. When the upper looper link 55 is rocked, the rotation angle θ2 of the upper looper link 55 lags the lower looper link 45 by a phase angle of 40 degrees as shown by curve A in FIG. 20 and is represented by a sine curve with a maximum rotation angle of about 40 degrees. When not being rocked, the upper looper link 55 is caused to stop at a location of the maximum rotation angle of about 40 degrees as shown by straight line B in FIG. 20.

Figure 21:
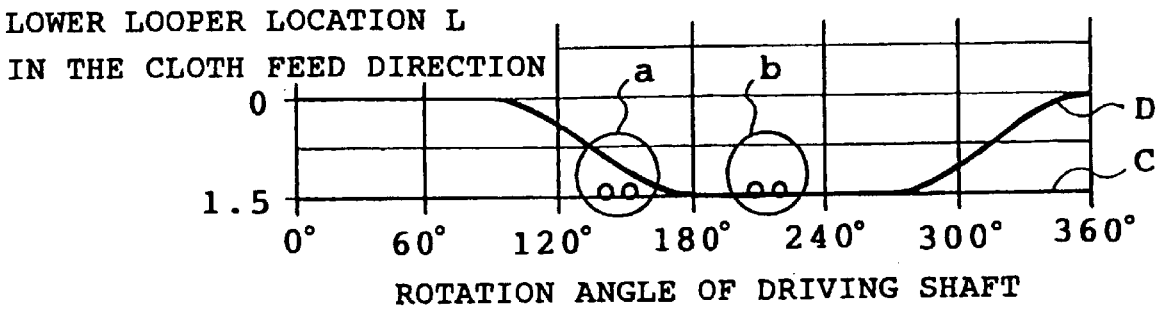
FIG. 21 is a graph showing the relationship between the rotation angle of the driving shaft and the forward and backward positions of the lower looper.

When not being driven forward and backward, the lower looper 5 is moved forward by 1.5 mm to be stopped as shown by straight line C in FIG. 21. The lower looper 5 crosses at its rear side the points of the pair of needles twice as shown by sections a and b in FIG. 21. When being driven forward and backward, the lower looper 5 is reciprocated with forward and backward movement of 1.5 mm as shown by curve D in FIG. 21. First, the pair of needles pass through the rear side of the lower looper 5 as shown by the section a. The needles then pass through the front side of the lower looper 5 as shown by the section b.

Figure 22:
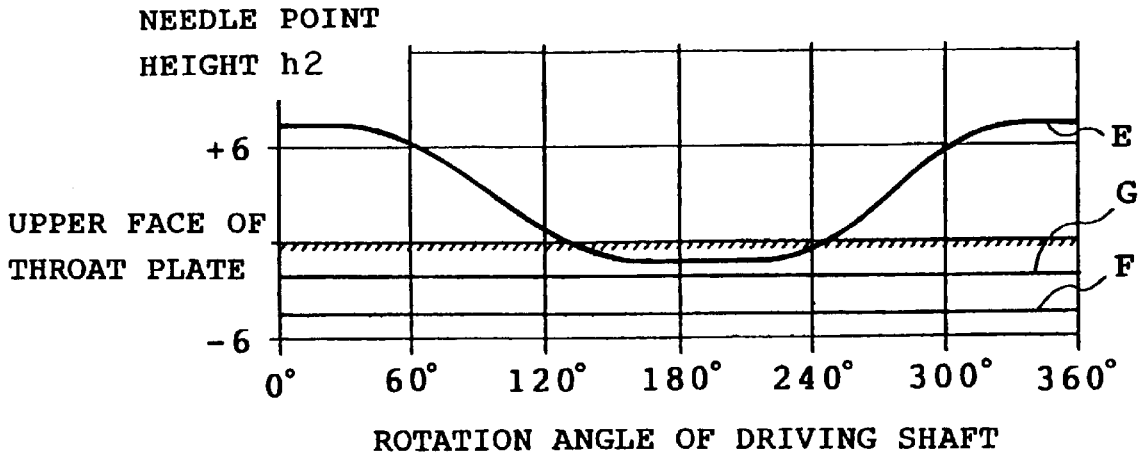
FIG. 22 is a graph showing the relationship between the rotation angle of the driving shaft and the height of the moving blade.

When the moving blade 8 is driven vertically, the edge thereof is driven vertically with forward and backward movement of about 8 mm and the maximum height of 6 mm as shown by curve E in FIG. 22. When the moving blade B is not driven vertically, the edge thereof is lowered about 4.5 mm to the lower side of the throat plate 9 to be stopped at the second inoperative position as shown by straight line F in FIG. 22. Alternatively, the edge of the moving blade 8 is lowered about 2 mm to the lower side of the throat plate 9 to be stopped at the first inoperative position as shown by straight line G in FIG. 22.

The operation of the over-lock sewing machine and the effects achieved therefrom will now be described. Since the first and second stepping motors 40 and 50 are provided for rocking the lower and upper loopers 5 and 6 respectively, the sewing machine requires no complicated mechanism for switching the upper looper 6 between the rockable state and the non-rockable state. Accordingly, the over-edge chain stitch can be executed by controlling the first and second stepping motors 40 and 50 so that the lower and upper loopers 5 and 6 are rocked. Furthermore, the double-chain stitch can be executed by rocking the lower looper 5 with the upper looper 6 being locked or stopped at the predetermined stop position. Consequently, the construction of the sewing machine M can be simplified and its manufacturing cost can be reduced. Furthermore, the amount of rocking and the rocking timing of each of the lower and upper loopers 5 and 6 can readily be adjusted.

The third stepping motor 60 is further provided for reciprocating the lower looper 5 between the front and rear sides of the needles 25. This eliminates a complicated mechanism for switching the lower looper 5 between the forward and backward driving state and the forward and backward non-driving state. In this construction, the over-edge chain stitch can be executed by controlling the third stepping motor 60 so that the lower looper 5 is stopped at the predetermined stop position. The double-chain stitch can be executed by reciprocating the lower looper 5 forward and backward. Consequently, the construction of the sewing machine M can be simplified and its manufacturing cost can be reduced. Furthermore, the amount of rocking and the rocking timing of the lower looper 5 can readily be adjusted.

The moving blade position switching mechanism 34 is provided for switching the position of the moving blade 8 driven vertically by the motor 35 between the operative position where the moving blade is able to cut the cloth end in cooperation with the fixed blade 7 and the inoperative position where the driving force of the motor 35 is not transmitted to the moving blade. Accordingly, the moving blade 8 can independently be switched between the operative and inoperative positions irrespective of the operation of the lower looper 5. Consequently, the over-edge chain stitch can be executed with or without the cloth end being cut, and the double-chain stitch can be executed with or without the cloth end being cut. Thus, the sewing machine M can perform four sewing modes.

The above-mentioned inoperative position of the moving blade 8 is the first inoperative position where the moving blade 8 protrudes from the upper face of the sewing bed in the over-edge chain stitch and the second inoperative position where the moving blade 8 is retracted inside the bed in the double-chain stitch. Accordingly, the protruding moving blade 8 can serve as a guide when the over-edge chain stitch is executed. Consequently, the cloth end and the needle location can be rendered constant such that fine stitches can be formed. Furthermore, since the moving blade 8 is retracted inside the bed in the double-chain stitch, the workpiece cloth can be moved freely on the bed face.

The moving blade position switching mechanism 34 includes the rocking motion transfer member 71 engaging the moving blade cam 70 secured to the driving shaft 36 to thereby transfer the driving force to the moving blade 8. The switching mechanism 34 is further provided with the fourth stepping motor 80 switching the rocking motion transfer member 71 to the position where the latter is not engaged with the moving blade cam 70. Consequently, the number of parts of the moving blade position switching mechanism 34 can be reduced and accordingly, the manufacturing cost can be reduced.

The first and second switches 15 and 17 are provided for switching the second and third stepping motors 50 and 60 between the operative and inoperative states respectively. Consequently, one of the above-mentioned four sewing modes can readily be selected by operating the first and second switches 15 and 17.

Figure 23:
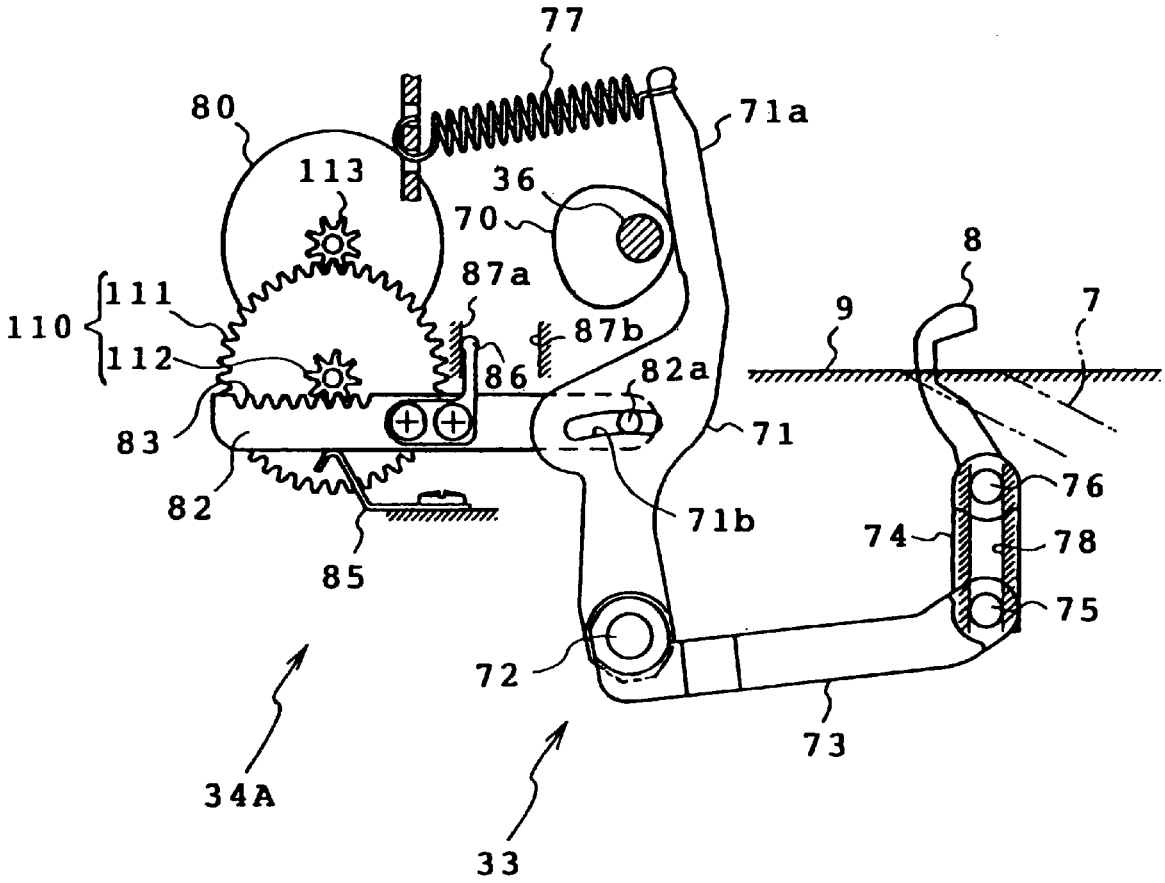
FIG. 23 is a left-hand side view of the moving blade position switching mechanism employed in the over-lock sewing machine of a second embodiment in accordance with the present invention.

A second embodiment of the present invention will be described with reference to FIG. 23. Identical or similar parts in the second embodiment are labeled by the same reference symbols as in the first embodiment. The moving blade position switching mechanism 34A comprises a combined gear assembly 110 including a large-diameter first gear 111 meshing the drive gear 113 secured to the output shaft of the fourth stepping motor 80 and a small-diameter second gear 112 meshing the rack 83. The provision of the gear assembly 110 increases the driving force forwardly driving the pushing member 82, resulting in application of the tension coil spring 77 with a large urging force. Furthermore, the rocking motion transfer member 71 can reliably abut the moving blade cam 70 so that the pushing member 82 is reliably driven forward against the urging force of the tension coil spring 77.

The moving blade position switching mechanisms 34 and 34A may be eliminated and another stepping motor (a fifth stepping motor in the invention) may be provided for vertically driving the moving blade 8 instead of driving the moving blade by the sewing machine motor 35. In this construction, the stepping motor is controlled so that the moving blade 8 is driven vertically and switched between the operative and inoperative positions. Consequently, the construction of the sewing machine M can further be simplified and the manufacturing cost thereof can further be reduced.

The four stepping motors 40, 50, 60 and 80 are provided in each of the foregoing embodiments. However, one, two, or three of these motors may be provided, instead. More specifically, only the lower looper 5 or only the upper looper 6 may be driven by the motor other than the sewing machine motor 35. Furthermore, only the motor for reciprocating the lower looper 5 between the front and rear sides of the needles 25 may differ from the sewing machine motor 35. Furthermore, only the motor for moving the rocking motion transfer member 71 of the moving blade position switching mechanism 34 may differ from the sewing machine motor 35. Additionally, only two or three of the above-described four motors may differ from the motor 35.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. An over-lock sewing machine comprising:

a sewing machine motor for driving a needle bar so that the needle bar is moved upward and downward;

a sewing needle mounted on a lower end of the needle bar;

an upper looper and a lower looper forming stitches in cooperation with the sewing needle; and a lower looper rocking stepping motor for driving the lower looper so that the lower looper is rocked.

2. An over-lock sewing machine according to claim 1, further comprising an upper looper rocking stepping motor for driving the upper looper so that the upper looper is rocked.

3. An over-lock sewing machine according to claim 1, further comprising a lower looper reciprocating stepping motor for driving the lower looper so that the lower looper is reciprocated back and forth between opposite sides of the needle.

4. An over-lock sewing machine according to claim 2, further comprising a lower looper reciprocating stepping motor for driving the lower looper so that the lower looper is reciprocated back and forth between opposite sides of the needle.

5. An over-lock sewing machine according to claim 1, further comprising a fixed blade, a moving blade driven upward and downward by the sewing machine motor so that the moving blade cuts an end of a workpiece cloth to be sewn in cooperation with the fixed blade immediately before a sewing operation, and a moving blade position switching mechanism for switching the moving blade between an operative position where the moving blade is permitted to cut the cloth end in cooperation with the fixed blade and an inoperative position where a driving force from the sewing machine motor is not transmitted to the moving blade.

6. An over-lock sewing machine according to claim 2, further comprising a fixed blade, a moving blade driven upward and downward by the sewing machine motor so that the moving blade cuts an end of a workpiece cloth to be sewn in cooperation with the fixed blade immediately before a sewing operation, and a moving blade position switching mechanism for switching the moving blade between an operative position where the moving blade is permitted to cut the cloth end in cooperation with the fixed blade and an inoperative position where a driving force from the sewing machine motor is not transmitted to the moving blade.

7. An over-lock sewing machine according to claim 3, further comprising a fixed blade, a moving blade driven upward and downward by the sewing machine motor so that the moving blade cuts an end of a workpiece cloth to be sewn in cooperation with the fixed blade immediately before a sewing operation, and a moving blade position switching mechanism for switching the moving blade between an operative position where the moving blade is permitted to cut the cloth end in cooperation with the fixed blade and an inoperative position where a driving force from the sewing machine motor is not transmitted to the moving blade.

8. An over-lock sewing machine according to claim 4, further comprising a fixed blade, a moving blade driven upward and downward by the sewing machine motor so that the moving blade cuts an end of a workpiece cloth to be sewn in cooperation with the fixed blade immediately before a sewing operation, and a moving blade position switching mechanism for switching the moving blade between an operative position where the moving blade is permitted to cut the cloth end in cooperation with the fixed blade and an inoperative position where a driving force from the sewing machine motor is not transmitted to the moving blade.

9. An over-lock sewing machine according to claim 5, which further comprises a sewing bed, and wherein the inoperative position of the moving blade is selectable to be either a first inoperative position where the moving blade projects from an upper face of the sewing bed in an over-edge chain stitch mode or a second inoperative position where the moving blade is retracted inside the sewing bed in a double-chain stitch mode.

10. An over-lock sewing machine according to claim 6, which further comprises a sewing bed, and wherein the inoperative position of the moving blade is selectable to be either a first inoperative position where the moving blade projects from an upper face of the sewing bed in an over-edge chain stitch mode or a second inoperative position where the moving blade is retracted inside the sewing bed in a double-chain stitch mode.

11. An over-lock sewing machine according to claim 7, which further comprises a sewing bed, and wherein the inoperative position of the moving blade is selectable to be either a first inoperative position where the moving blade projects from an upper face of the sewing bed in an over-edge chain stitch mode or a second inoperative position where the moving blade is retracted inside the sewing bed in a double-chain stitch mode.

12. An over-lock sewing machine according to claim 8, which further comprises a sewing bed, and wherein the inoperative position of the moving blade is selectable to be either a first inoperative position where the moving blade projects from an upper face of the sewing bed in an over-edge chain stitch mode or a second inoperative position where the moving blade is retracted inside the sewing bed in a double-chain stitch mode.

13. An over-lock sewing machine according to claim 5, which further comprises a driving shaft and a cam secured to the driving shaft, and wherein the moving blade position switching mechanism includes a rocking motion transfer member engaging the cam to thereby transfer a driving force to the moving blade, and a transfer member moving stepping motor for moving the rocking motion transfer member to a position where the rocking motion transfer member is in disengagement from the cam.

14. An over-lock sewing machine according to claim 6, which further comprises a driving shaft and a cam secured to the driving shaft, and wherein the moving blade position switching mechanism includes a rocking motion transfer member engaging the cam to thereby transfer a driving force to the moving blade, and a transfer member moving stepping motor for moving the rocking motion transfer member to a position where the rocking motion transfer member is in disengagement from the cam.

15. An over-lock sewing machine according to claim 7, which further comprises a driving shaft and a cam secured to the driving shaft, and wherein the moving blade position switching mechanism includes a rocking motion transfer member engaging the cam to thereby transfer a driving force to the moving blade, and a transfer member moving stepping motor for moving the rocking motion transfer member to a position where the rocking motion transfer member is in disengagement from the cam.

16. An over-lock sewing machine according to claim 8, which further comprises a driving shaft and a cam secured to the driving shaft, and wherein the moving blade position switching mechanism includes a rocking motion transfer member engaging the cam to thereby transfer a driving force to the moving blade, and a transfer member moving stepping motor for moving the rocking motion transfer member to a position where the rocking motion transfer member is in disengagement from the cam.

17. An over-lock sewing machine according to claim 14, further comprising a control section for controlling the lower looper rocking, upper looper rocking and transfer member moving stepping motors, a first switch electrically connected to the control section for switching the upper looper rocking stepping motor between an operative state and inoperative state, and a second switch electrically connected to the control section for switching the transfer member moving stepping motor between an operative position and an inoperative position.

18. An over-lock sewing machine according to claim 16, further comprising a control section for controlling all the stepping motors, a first switch electrically connected to the control section for switching the upper looper rocking stepping motor between an operative state and an inoperative state, and a second switch electrically connected to the control section for switching the transfer member moving stepping motor between an operative position and inoperative position.

19. An over-lock sewing machine according to claim 17, further comprising a first LED turned on when the first switch is turned on and turned off when the first switch is turned off, and a second LED turned on when the second switch is turned on and turned off when the second switch is turned off.

20. An over-lock sewing machine according to claim 18, further comprising a first LED turned on when the first switch is turned on and turned off when the first switch is turned off, and a second LED turned on when the second switch is turned on and turned off when the second switch is turned off.

21. An over-lock sewing machine according to claim 19, which further comprises a sewing machine body, and wherein the first switch and the first LED are disposed on the sewing machine body and the sewing machine body carries an indicia representative of a double-chain stitch near the first switch and the first LED, and wherein the second switch and the second LED are disposed on the sewing machine body and the sewing machine body carries an indicia representative of an inoperative state of the moving blade near the second switch and the second LED.

22. An over-lock sewing machine according to claim 20, which further comprises a sewing machine body, and wherein the first switch and the first LED are disposed on the sewing machine body and the sewing machine body carries an indicia representative of a double-chain stitch near the first switch and the first LED, and wherein the second switch and the second LED are disposed on the sewing machine body and the sewing machine body carries an indicia representative of an inoperative state of the moving blade near the second switch and the second LED.

23. An over-lock sewing machine according to claim 1, further comprising a fixed blade, a moving blade for cutting an end of a workpiece cloth to be sewn in cooperation with the fixed blade, and a blade driving stepping motor for driving the moving blade upward and downward.

24. An over-lock sewing machine according to claim 2 further comprising a fixed blade, a moving blade for cutting an end of a workpiece cloth to be sewn in cooperation with the fixed blade, and a blade driving stepping motor for driving the moving blade upward and downward.

25. An over-lock sewing machine comprising:

a sewing machine motor for driving a needle bar so that the needle bar is moved upward and downward;

a sewing needle mounted on a lower end of the needle bar;

an upper looper and a lower looper forming stitches in cooperation with the sewing needle; and a upper looper rocking stepping motor for driving the upper looper so that the upper looper is rocked.

26. An over-lock sewing machine comprising:

a sewing machine motor for driving a needle bar so that the needle bar is moved upward and downward;

a sewing needle mounted on a lower end of the needle bar;

an upper looper and a lower looper forming stitches in cooperation with the sewing needle; and a lower looper reciprocating stepping motor for driving the lower looper so that the lower looper is reciprocated back and forth between opposite sides of the needle.

27. An over-lock sewing machine comprising:

a sewing machine motor for driving a needle bar so that the needle bar is moved upward and downward;

a sewing needle mounted on a lower end of the needle bar;

an upper looper and a lower looper forming stitches in cooperation with the sewing needle;

a fixed blade;

a moving blade driven upward and downward by the sewing machine motor so that the moving blade cuts an end of a workpiece cloth to be sewn in cooperation with the fixed blade immediately before a sewing operation;

a moving blade position switching mechanism for switching the moving blade between an operative position where the moving blade is permitted to cut the cloth end in cooperation with the fixed blade and an inoperative position where a driving force from the sewing machine motor is not transmitted to the moving blade;

a driving shaft; and a cam secured to the driving shaft, the moving blade position switching mechanism including a rocking motion transfer member engaging the cam to thereby transfer a driving force to the moving blade, and a transfer member moving stepping motor for moving the rocking motion transfer member to a position where the rocking motion transfer member is in disengagement from the cam.

28. An over-lock sewing machine comprising:

a sewing machine motor for driving a needle bar so that the needle bar is moved upward and downward;

a sewing needle mounted on a lower end of the needle bar;

an upper looper and a lower looper forming stitches in cooperation with the sewing needle;

a fixed blade;

a moving blade driven upward and downward by the sewing machine motor so that the moving blade cuts an end of a workpiece cloth to be sewn in cooperation with the fixed blade immediately before a sewing operation;

a moving blade position switching mechanism for switching the moving blade between an operative position where the moving blade is permitted to cut the cloth end in cooperation with the fixed blade and an inoperative position where a driving force from the sewing machine motor is not transmitted to the moving blade; and a sewing bed;

wherein the inoperative position of the moving blade is selectable to be either a first inoperative position where the moving blade projects from an upper face of the sewing bed in an over-edge chain stitch mode or a second inoperative position where the moving blade is retracted inside the sewing bed in a double-chain stitch mode.

29. An over-lock sewing machine comprising:

a sewing machine motor for driving a needle bar so that the needle bar is moved upward and downward;

a sewing needle mounted on a lower end of the needle bar;

an upper looper and a lower looper forming stitches in cooperation with the sewing needle;

a fixed blade;

a moving blade driven upward and downward by the sewing machine motor so that the moving blade cuts an end of a workpiece cloth to be sewn in cooperation with the fixed blade immediately before a sewing operation; and a blade driving stepping motor for driving the moving blade upward and downward.

30. An over-lock sewing machine comprising:

a sewing machine motor for driving a needle bar so that the needle bar is moved upward and downward;

a sewing needle mounted on a lower end of the needle bar;

a plurality of loopers forming stitches in cooperation with the sewing needle; and an actuator for actuating said at least one looper so that the looper is rocked.

* * * * *